US007031924B2

(12) United States Patent
Kimura et al.

(10) Patent No.: US 7,031,924 B2
(45) Date of Patent: Apr. 18, 2006

(54) VOICE SYNTHESIZING APPARATUS, VOICE SYNTHESIZING SYSTEM, VOICE SYNTHESIZING METHOD AND STORAGE MEDIUM

(75) Inventors: Hiroyuki Kimura, Kanagawa (JP); Tomoyuki Isonuma, Kanagawa (JP); Hironori Goto, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 797 days.

(21) Appl. No.: 09/891,389

(22) Filed: Jun. 27, 2001

(65) Prior Publication Data

US 2002/0019736 A1 Feb. 14, 2002

(30) Foreign Application Priority Data

Jun. 30, 2000 (JP) ..... 2000-199929
Jul. 6, 2000 (JP) ..... 2000-204959
Jul. 14, 2000 (JP) ..... 2000-214140

(51) Int. Cl.
*G10L 21/00* (2006.01)

(52) U.S. Cl. ..... 704/274; 704/260

(58) Field of Classification Search ..... 704/258–270
See application file for complete search history.

(56) References Cited

U.S. PATENT DOCUMENTS 4,359,713 A * 11/1982 Tsunoda ..... 704/274
6,182,040 B1 * 1/2001 Monaco ..... 704/260
6,574,600 B1 * 6/2003 Fishman et al. ..... 704/270

* cited by examiner

*Primary Examiner*—Abul K. Azad
(74) *Attorney, Agent, or Firm*—Fitzpatrick, Cella, Harper & Scinto

(57) ABSTRACT

There are provided a voice outputting apparatus, a voice outputting system, a voice outputting method and a storage medium which, when the synthetic voices of a plurality of text data are to be uttered in overlapping relationship with each other, voice-synthesize the plurality of text data with different kinds of voices and to be outputted, thereby enabling the voices of the plurality of text data to be heard easily. The voice outputting apparatus is provided with a voice waveform generating portion for generating the voice waveform of text data, and a voice output portion for causing, when the overlapping of the voice outputs of a plurality of text data is detected, the respective text data to be outputted in different voices, or from discrete speakers, or in voices of different heights.

24 Claims, 27 Drawing Sheets

VOICE SYNTHESIZING APPARATUS, VOICE SYNTHESIZING SYSTEM, VOICE SYNTHESIZING METHOD AND STORAGE MEDIUM

BACKGROUND OF THE INVENTION

1. Field of the Invention

This invention relates to a voice synthesizing apparatus, a voice synthesizing system, a voice synthesizing method and a storage medium, and particularly to a voice synthesizing apparatus, a voice synthesizing system, a voice synthesizing system and a storage medium suitable for a case where text data is converted into a synthetic voice and outputted.

2. Description of the Related Art

There has heretofore been a voice synthesizing apparatus having the function of voice-outputting character information. In the voice synthesizing apparatus according to the prior art, data to be voice-outputted had to be prepared as text data electronized in advance. That is, the text data is a text prepared by an editor on a personal computer, a word processor, or the like, or HTML (hyper text markup language) text on Internet.

Also, in almost all of cases where the text data as described above are outputted in voices from the voice synthesizing apparatus, the text data from an input has been outputted in a kind of voice preset in the voice synthesizing apparatus.

However, the above-described voice synthesizing apparatus according to the prior art has suffered from the problem that it cannot receive the input of a plurality of text data at a time, superimpose and output the synthetic voice outputs thereof, and output them so as to be heard out.

SUMMARY OF THE INVENTION

The present invention has been made in view of the above-noted point and an object thereof is to provide a voice synthesizing apparatus, a voice synthesizing system, a voice synthesizing method and a storage medium designed to be capable of hearing a plurality of text data in a loud voice in conformity with the importance thereof even when they are uttered at a time.

Also, the present invention has been made in view of the above-noted point and an object thereof is to provide a voice outputting apparatus, a voice outputting system, a voice outputting method and a storage medium which, when the synthetic voices of a plurality of text data are to be superimposed and uttered, voice-synthesize and output the plurality of text data in different kinds of voices to thereby enable the voices of the plurality of text data to be heard out easily.

It is also an object of the present invention to provide a voice outputting apparatus, a voice outputting system, a voice outputting method and a storage medium which, when the synthetic voices of a plurality of text data are to be superimposed and uttered, utter the voices of the plurality of text data by respective different uttering means to thereby enable the voices of the plurality of text data to be heard out easily.

It is also an object of the present invention to provide a voice synthesizing apparatus, a voice synthesizing system, a voice synthesizing method and a storage medium which, when the overlapping of the reproduction timing of the synthetic voices of a plurality of text data is detected, increase the speed of voice reproduction in conformity with the presence or absence of a voice waveform presently under reproduction or the number of voice waveforms waiting for reproduction to thereby enable reproduced voices to be heard without the plurality of text data being uttered at a time to make them difficult to hear, and in a state in which the waiting time till the voice reproduction is short to the utmost.

It is also an object of the present invention to provide a voice synthesizing apparatus, a voice synthesizing system, a voice synthesizing method and a storage medium which, when the connection of the reproduction timing of the synthetic voices of a plurality of text data is detected, provide a predetermined blank period for making punctuation clear after a voice waveform presently under reproduction to thereby eliminate the connection of the plurality of text data and make the punctuation of voice information clearly known and thus enable the voice information to be heard out easily.

It is also an object of the present invention to provide a voice synthesizing apparatus, a voice synthesizing system, a voice synthesizing method and a storage medium which, when the connection of the reproduction timing of the synthetic voices of a plurality of text data is detected, perform the reproduction of a specific voice synthesis waveform for making it known that it is discrete information after a voice waveform presently under reproduction, to thereby enable the punctuation of the voice information to be known distinctly even when the plurality of text data are utterned while being connected and thus enable the voice information to be heard out easily.

According to an embodiment of the present invention, there is provided a voice synthesizing apparatus for converting text data into a synthetic voice and outputting it, characterized by voice waveform generating means for generating the voice waveforms of the text data, and voice outputting means for voice-synthesizing a plurality of text data with different kinds of voices and outputting them.

DESCRIPTION OF THE PREFERRED EMBODIMENTS

Some embodiments of the present invention will hereinafter be described in detail with reference to the drawings.

First Embodiment

An embodiment of the present invention is a system for voice-outputting text data sent from other computer (a server computer) in non-synchronism with the latter is a system for voice-outputting text data sent from other computer (server computer), wherein before the voice outputting of a text datum is completed, when the next text datum is sent, a voice earlier under voice output and a voice outputting later in superimposed relation therewith are outputted with the volume rate thereof changed in accordance with the parameter of the importance set in those text data. While in the present embodiment, description will be made on the premise that two or more voices do not overlap each other, similar processing can be effected even when three or more voices are expected to overlap one another.

Figure 1:
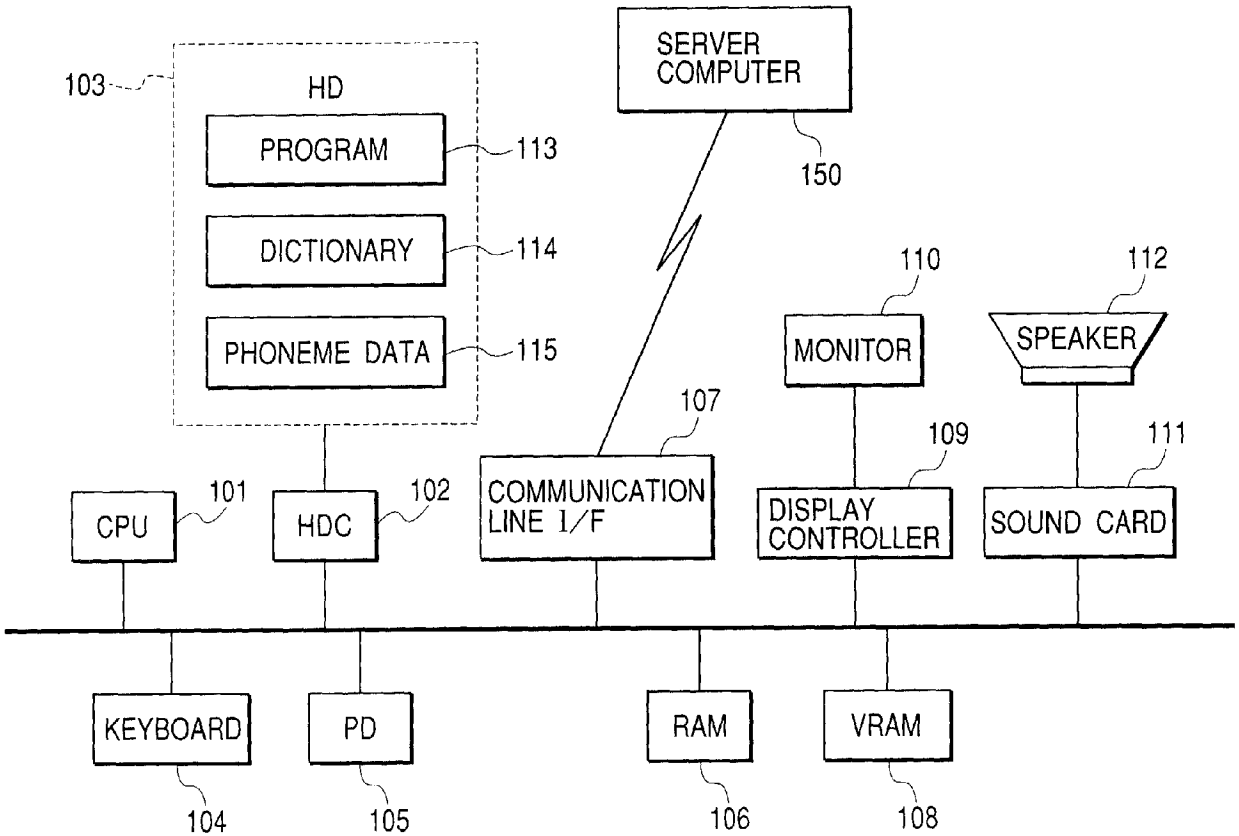
FIG. 1 is a block diagram showing an example of the construction of a voice synthesizing apparatus according to embodiments (1, 6 and 7) of the present invention.

FIG. 1 is a block diagram showing an example of the construction of a voice synthesizing apparatus according an embodiment of the present invention. The voice synthesizing apparatus is provided with a CPU 101, a hard disc controller (HDC) 102, a hard disc (HD) 103, a keyboard 104, a pointing device (PD) 105, a RAM 106, a communication line interface (I/F) 107, VRAM 108, a display controller 109, a monitor 110, a sound card 111 and a speaker 112. In FIG. 1, the reference numeral 150 designates a server computer.

The construction of each of the above-mentioned portions will be described in detail below. The CPU 101 is a central processing unit for effecting the control of the entire apparatus, and executes the processing shown in the flow chart of FIG. 4 which will be described later. The hard disc controller 102 effects the control of data and a program in the hard disc 103. In the hard disc 103, there are stored a program 113, a dictionary 114 in which are registered the Japanese equivalents of kanjis and accent information to be referred to when in a voice waveform generating portion (which will be described later), inputted sentences consisting of a mixture of kanjis and kanas are analyzed to thereby obtain reading information, and phoneme data 115 which become necessary when phonemes are to be connected together in accordance with rows of characters uttered.

The keyboard 104 is used for the inputting of characters, numerals, symbols, etc. The pointing device 105 is used to indicate the starting or the like of the program, and is comprised, for example, of a mouse, a digitizer, etc. The RAM 106 stores a program and data therein. The communication line interface 107 effects the exchange of data with the external server computer 150. In the present embodiment, TCP/IP (Transmission Control Protocol/Internet Protocol) is used as the communication form. The display controller 109 effects the control of outputting image data stored in the VRAM 108 as an image signal to the monitor 110. The sound card 111 outputs voice waveform data generated by the CPU 101 and stored in the RAM 106 through the speaker 112.

Figure 2:
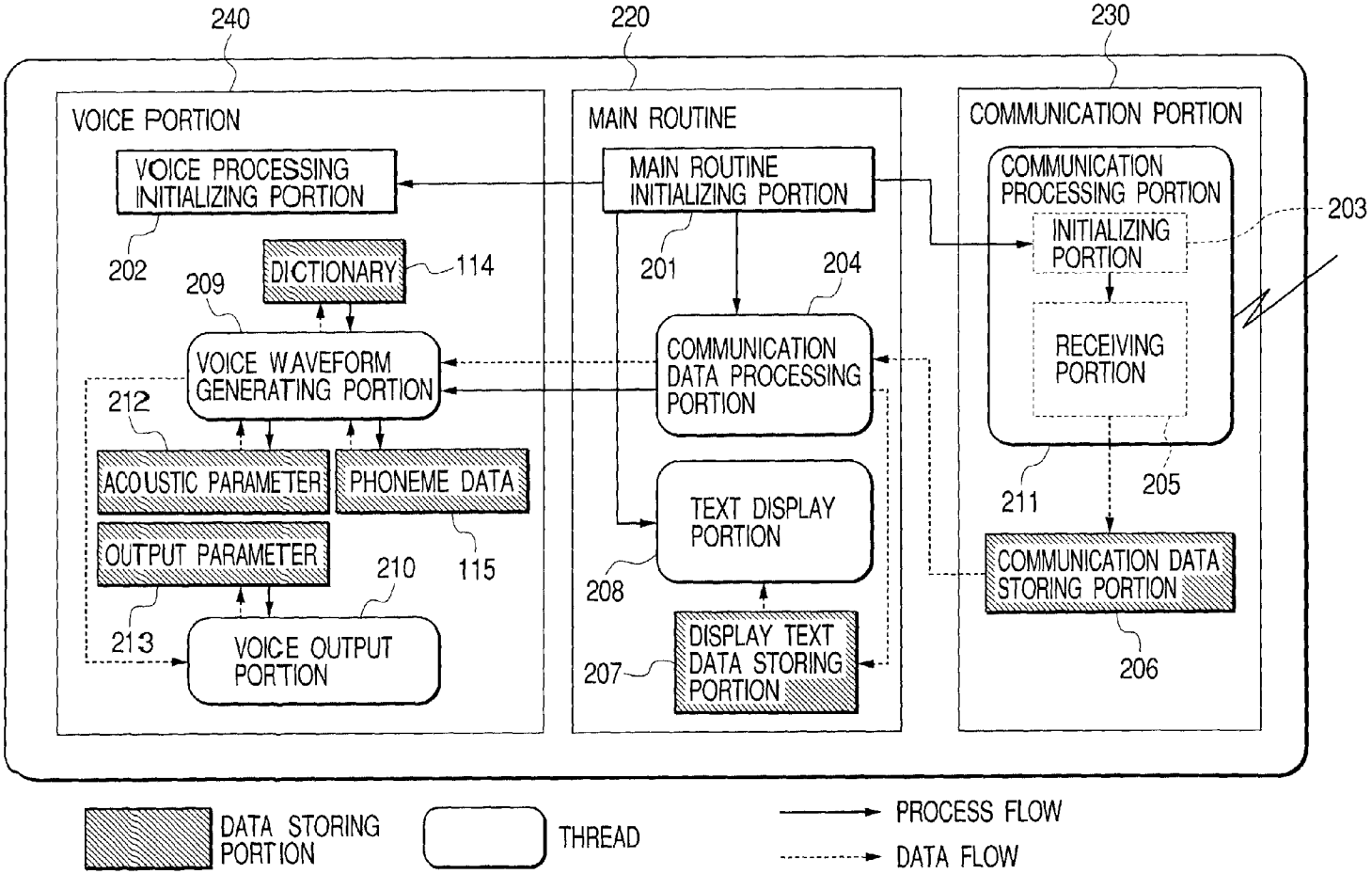
FIG. 2 is an illustration showing an example of the construction of the module of the program of the voice synthesizing apparatus according to the embodiments (1 to 7) of the present invention.

FIG. 2 is an illustration showing the module relation of the program of the voice synthesizing apparatus according to the embodiment of the present invention. The voice synthesizing apparatus is provided with the dictionary 114, the pheneme data 115, a main routine initializing portion 201, a voice processing initializing portion 202, a communication data processing portion 204, a communication data storing portion 206, a display text data storing portion 207, a text display portion 208, a voice waveform generating portion 209, a voice output portion 210, a communication processing portion 211 having an initializing portion 203 and a receiving portion 205, an acoustic parameter 212 and an output parameter 213.

The function of each of the above-mentioned portions will be described in detail below. When the system of the present embodiment is started, the initialization of the entire program is first effected by the main routine initializing portio 201 of a main routine 220. Next, the initialization of a communication portion 230 is effected by the initializing portion 203 of the communication processing portion 211, and the initialization of a voice portion 240 is effected by the voice processing initializing portion 202. In the present embodiment, TCP/IP is used as the communication form.

When the initialization of the communication portion 230 is completed by the initializing portion 203 of the communication processing portion 211, the receiving portion 205 of the communication processing portion 211 is started and text data transmitted from the server computer 150 to the voice synthesizing apparatus can be received. When this text data is received by the receiving portion 205 of the communication processing portion 211, the received text data is stored in the communication data storing portion 206.

When the initialization of the whole of the main routine 220 is completed by the main routine initializing portion 201, the communication data processing portion 204 starts the monitoring of the communication data storing portion 206. When the received text data is stored in the communication data storing portion 206, the communication data processing portion 204 reads the text data, and stores the text data in the display text data storing portion 207 for storing therein a display text to be displayed on the monitor 110.

The text display portion 208, when it detects that there is data in the display text data storing portion 207, converts the data into a form capable of being displayed on the monitor 110, and places it on the VRAM 108. As the result, the display text is displayed on the monitor 110. When at this time, in accordance with a parameter indicative of the importance of text data, the text data is to be subjected to some processing and made into a display text (for example, in the case of an important text, characters are to be made large or thickened or changed in color), that processing is effected by the communication data processing portion 204.

Also, the communication data processing portion 204 sends the received text data to the voice waveform generating portion 209, by which the generation of the voice waveform of the text data is effected. When at that time, the text data is to be subjected to some processing to thereby generate a voice waveform, that processing is effected by the communication data processing portion 204. In the voice waveform generating portion 209, the voice waveform of the received text data is generated while the dictionary 114, the phoneme data 115 and the acoustic parameter 212 are referred to. The generated waveform is delivered to the voice output portion 210 having the mixing function, with a parameter indicative of the importance thereof being given thereto.

Figure 3:
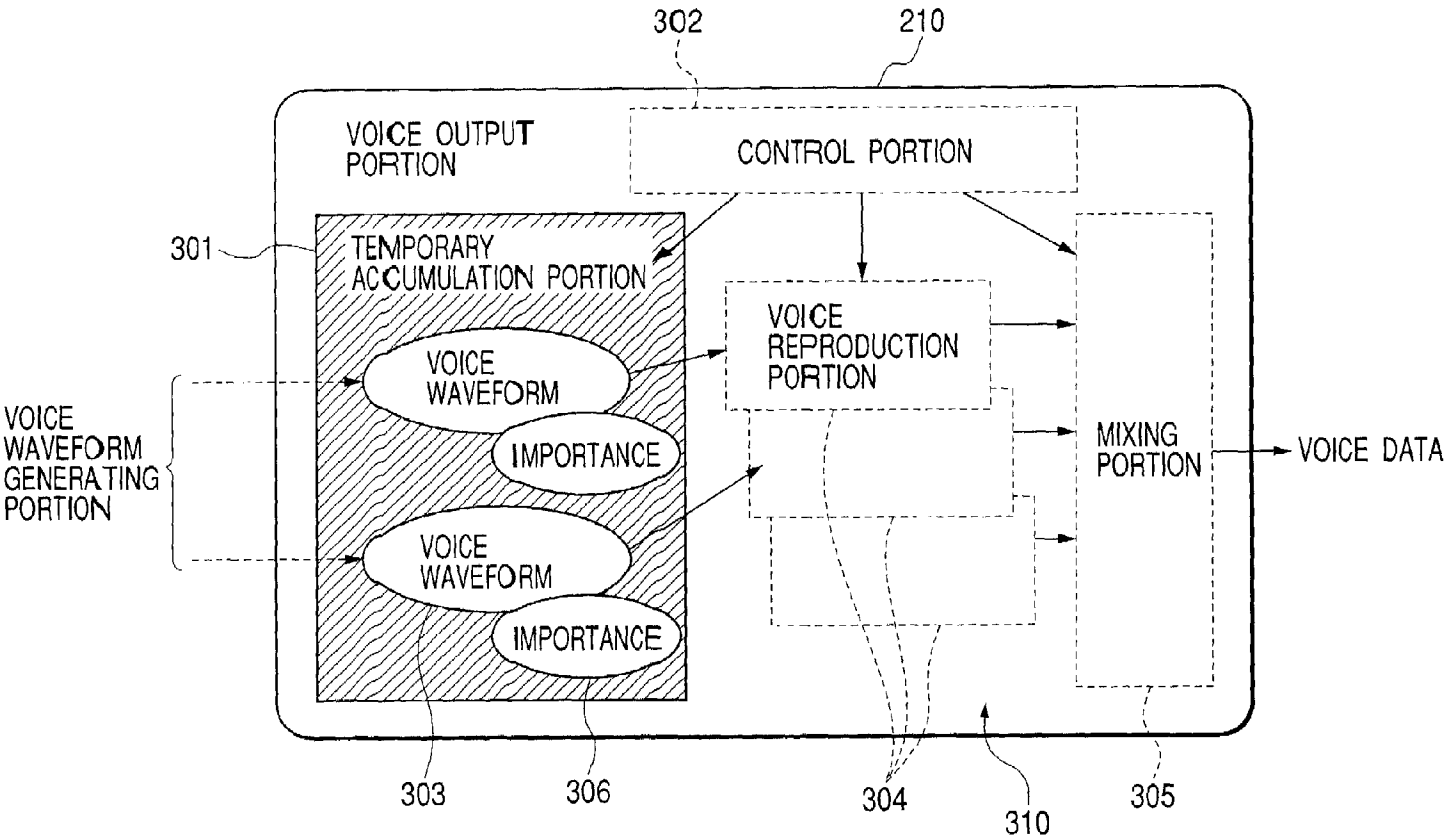
FIG. 3 is an illustration showing an example of the detailed construction of a voice output portion in the module of the program of the voice synthesizing apparatus according to the embodiment (1) of the present invention.

FIG. 3 is an illustration showing the detailed construction of the voice output portion 210 of the voice synthesizing apparatus according to the embodiment of the present invention. The voice output portion 210 of the voice synthesizing apparatus is provided with a temporary accumulation portion 301, a control portion 302, a voice reproduction portion 304 and a mixing portion 305. In FIG. 3, the reference numeral 303 designates a voice waveform, and the reference numeral 306 denotes an importance parameter.

The function of each of the above-mentioned portions will be described in detail below. The temporary accumulation portion 301 temporarily accumulates therein a voice waveform 303 having a parameter 306 indicative of the importance (or degree of the importance) thereof given thereto which has been sent from the voice waveform generating portion 209. The control portion 302 serves to control the whole of the voice output portion 210, and normally checks up whether the voice waveform 303 has been sent to the temporary accumulation portion 301, and when the voice waveform 303 has been sent to the temporary accumulation portion, the control portion 302 sends it to the voice reproduction portion 304, which thus starts voice reproduction.

The voice reproduction portion 304 executes the reproduction of the voice waveform 303 in accordance with a preset parameter (such as a sampling rate or the bit number of the data) necessary for the voice output from the output parameter 213 of FIG. 2. At least two (actually a number by which voice syntheses are expected at a time) voice reproduction portions 304 exist, and when the voice waveform 303 has been sent, the control portion 302 sends the voice waveform 303 to the voice reproduction portion 304 that is not being used at that point of time, and executes reproduction. Also, the voice reproduction portion 304 may be constructed as a software-like process, and the control portion 302 may be of such a construction as generates the process of the voice reproduction portion 304 each time the voice waveform 303 is sent, and extinguishes the process of that voice reproduction portion 304 at a point of time whereat the reproduction of the voice waveform 303 has ended.

Individual voice data outputted by the voice reproduction portions 304 are sent to the mixing portion 305 having at least two (actually a number by which voice syntheses are expected at a time) input portions, and the mixing portion 305 synthesizes the voice data and outputs final synthetic voice data from the speaker 112 of FIG. 1. At this time, the control portion 302 is adapted to effect the volume adjustment of individual mixing to the mixing portion 305 in accordance with the importance parameter 306 indicative of the importance of that voice waveform which has been sent together with the voice waveform 303.

Figure 4:
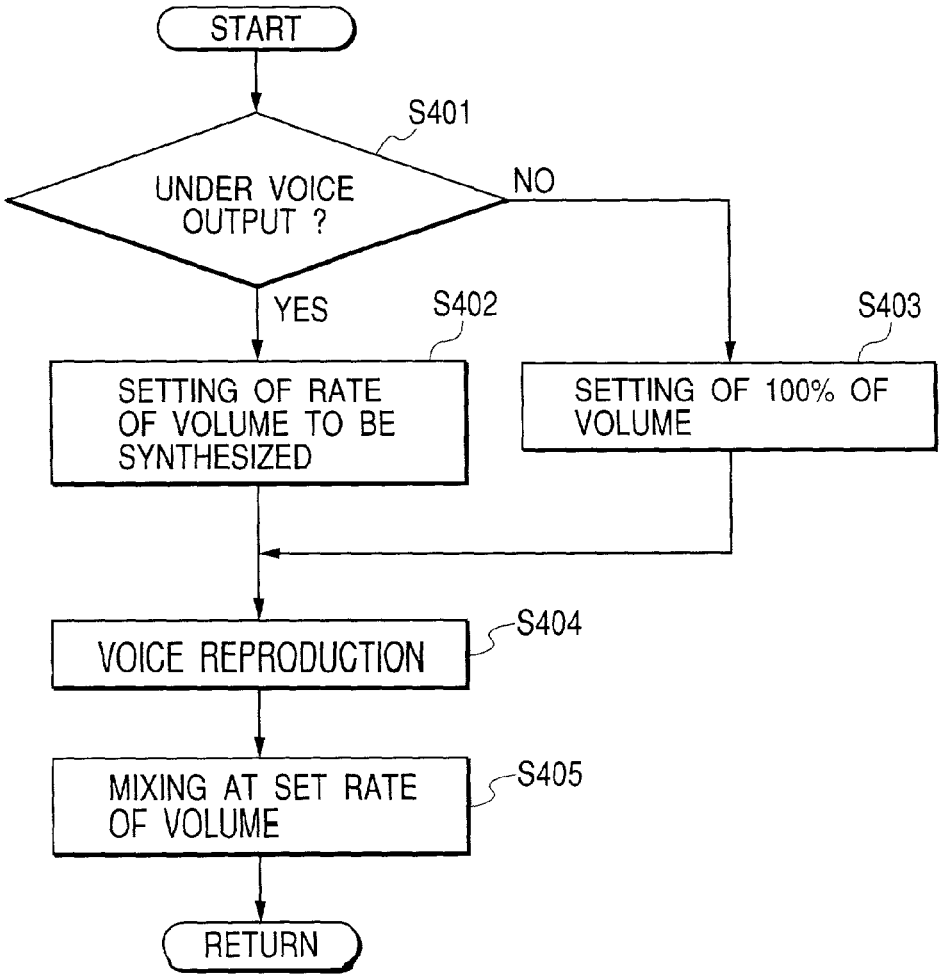
FIG. 4 is a flow chart showing the processing from the time when a voice waveform is sent from the voice waveform generating portion of the voice synthesizing apparatus according to the embodiment (1) of the present invention to the voice output portion until a voice is outputted.
Figure 5:
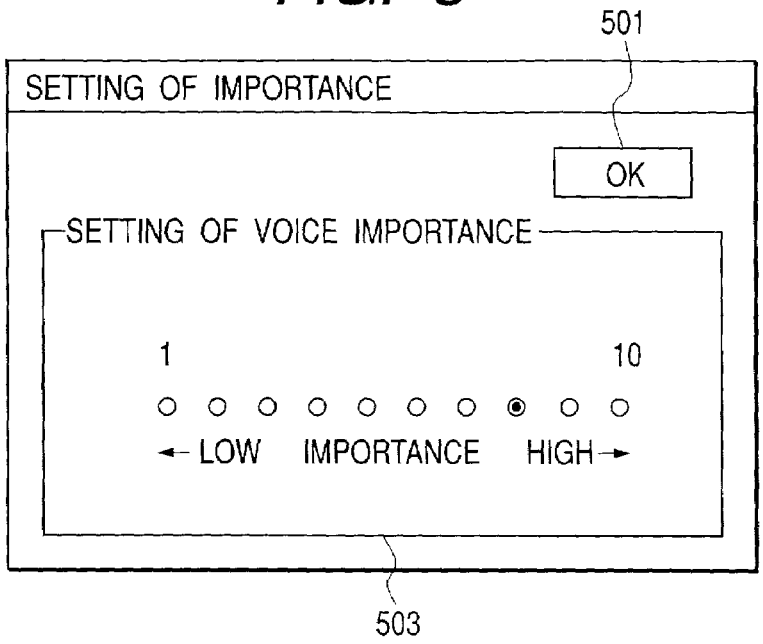
FIG. 5 is an illustration showing a setting screen for the importance of voices displayed on the monitor of the voice synthesizing apparatus according to the embodiment (1) of the present invention.

The operation of the voice synthesizing apparatus according to the embodiment of the present invention constructed as described above will now be described in detail with reference to FIGS. 4 and 5. FIG. 4 is a flow chart of the processing from the time when the voice waveform has been sent from the voice waveform generating portion 209 of the voice synthesizing apparatus to the voice output portion 210 until a voice is outputted, and FIG. 5 is an illustration showing a setting screen for setting the importance of voices displayed on the monitor 110 of the voice synthesizing apparatus.

First, at a step S401, the control portion 302 examines the operative state of the voice reproduction portions 304 and confirms whether they are outputting voices. If as the result, they are outputting voice, at a step S402, the control portion 302 effects the setting of the rate of volumes to be synthesized (a method of setting the rate of volumes to be synthesized will be described later) by the use of the importance parameter 306 of the voice presently under output and the importance parameter 306 of a voice to be outputted from now. If the voice reproduction portions 304 are not outputting voices, at a step S403, the setting that the volume is 100% to the voice to be outputted from now is effected.

Next, at a step S404, the reproduction of the voice waveform is effected by the use of one of the voice reproduction portions 304. The reproduced voice is subjected to the mixing of a necessary volume at a step S405, and becomes the output of a final voice. If at this time, there is other voice presently under output in the voice reproduction portion 304, a newly reproduced voice is mixed with the voice presently under output by the mixing portion 305 in accordance with the rate of volume set at the above-described step S402, and voice outputting is done. If there is no voice presently under output, the reproduced voice passes through the mixing portion 305, but is not subjected to any processing and voice outputting is intactly done because at the step S403, the setting of 100% of volume is done intactly.

When as described above, it is detected that a plurality of voice outputs overlap each other, the rate of volumes to be synthesized is changed in conformity with the importance of each voice, whereby even if a plurality of voices overlap each other, they can be heard at a volume conforming to the importance.

Description will now be made of the process of setting the importance concerned with each text datum.

When as previously described, the overlap of a plurality of text data is detected, the program routine, not shown, of the CPU 101 operates in conformity with this detection output, and controls the VRAM 108 and the display controller 110 to thereby cause the importance setting screen shown in FIG. 5 to be displayed on the monitor 110.

In the setting screen of FIG. 5 for setting the importance displayed on the monitor 110 of the voice synthesizing apparatus, the operator selects the parameter of the importance of each text datum by a "voice importance setting" area 503. In this setting screen, the importance can be set, for example, to levels of 1 to 10, and greater numbers indicate higher importance. The operator depresses "OK" button 501, whereby the parameter of the set importance is given to the text data voice-synthesized.

A method of setting the voices to be synthesized is such that when the importance parameter of a voice presently under output is a and the importance parameter of a voice to be outputted from now is b, the rate of volume of the voice presently under output becomes a/(a+b) and the rate of volume of the voice to be outputted from now becomes b/(a+b).

While herein, the importance has been set with respect to each of the two text data, design may be made such that the setting of the importance b is effected with respect only to one of the two text data, for example, the text data received later, and the importance a of the preceding text data may be automatically set so as to become (a+b=10).

Also, when there is the possibility of three or more voices overlapping one another, the rate of volume of each output is a value obtained by dividing the value of its importance parameter by the sum total of the importance parameters of all voices outputted in overlapping relationship with one another.

While in the above-described setting, the volume is adapted to be set in proportion to the importance, with regard to data of particularly high importance, it is possible to effect such setting as allots a particularly great volume.

Also, while in the present embodiment, the user has arbitrarily set the importance by the use of the setting screen of FIG. 5, this is not restrictive, but the volume of synthetic voice concerned with each text datum may be determined by the use of the importance data added to the respective text data sent from the server 150.

As described above, according to the voice synthesizing apparatus according to the embodiment of the present invention, when a plurality of voice outputs overlap one another, the rate of volume is determined in conformity with the importance of that voice and therefore, the voice can be heard at a volume conforming to the importance thereof. If the present embodiment is used, for example, in a system for voice-broadcasting text information sent from each place in a recreation ground through a server computer, the parameters of importance are set in conformity with such information as an event guide, missing child information and emergency refuge instructions, whereby even if voice broadcasts are effected at a time, the efficient use that more important information can be heard at a greater volume.

While in the above-described embodiment of the present invention, the cases of voice broadcast regarding an event guide/missing child information emergency refuge instructions, etc. in a recreation ground have been mentioned as specific examples to which the voice synthesizing apparatus is applied, the voice synthesizing apparatus is applicable to various fields such as voice broadcast regarding an entertainment guide/reference calls, etc. in various entertainment facilities such as motor shows, voice broadcast regarding a raceguide/reference calls, etc. in various sports facilities such as car race facilities, etc., and an effect similar to that of the above-described embodiment is obtained.

As described above, there is achieved the effect that there can be provided a voice synthesizing apparatus which, when the synthetic voices of a plurality of text data are to be uttered in overlapping relationship with one another, causes the respective text data to be uttered with the rates of volume thereof changed in conformity with the importance thereof, whereby as described above, even when a plurality of text data are uttered at a time, they can be heard in loud voice in conformity with the importance thereof.

Also, a voice synthesizing system is comprised of a voice synthesizing apparatus and an information processing apparatus for transmitting text data to the voice synthesizing apparatus, whereby as described above, there is achieved the effect that even when a plurality of text data are uttered at a time, they can be heard in loud voice in conformity with the importance thereof.

Also, a voice synthesizing method is executed by the voice synthesizing apparatus, whereby as described above, there is achieved the effect that even when a plurality of text data are uttered at a time, they can be heard in loud voice in conformity with the importance thereof.

Also, the voice synthesizing method is read out of a storage medium and is executed by the voice synthesizing apparatus, whereby as described above, there is achieved the effect that even when a plurality of text data are uttered at a time, they can be heard in loud voice in conformity with the importance thereof.

Second Embodiment

A second embodiment of the present invention is a system for voice-outputting text data non-synchronously sent from other computer (server computer), wherein before the voice outputting of a text datum is completed, when the next text data is sent, the next text data is read with the voice of other sexuality than the voice of sexuality earlier under voice output.

Figure 11:
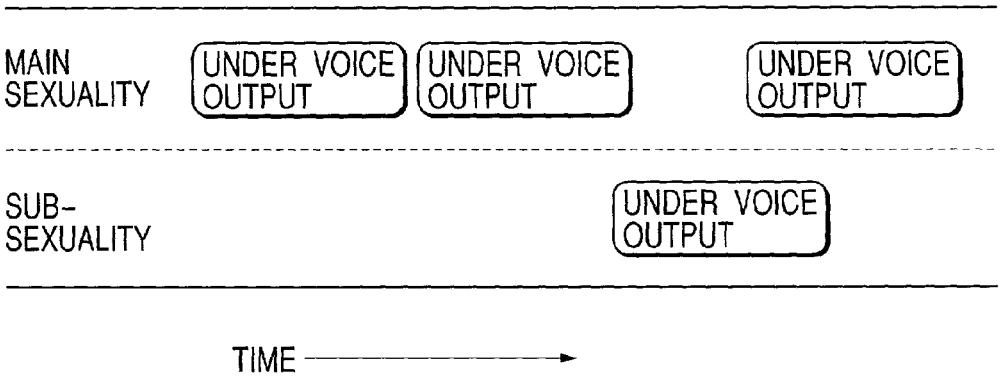
FIG. 11 is a conceptual view showing the time relation between the output voice by main sexuality and the output voice by sub-sexuality in the voice synthesizing apparatus according to the embodiment (2) of the present invention.

In the present embodiment, the sexuality used as ordinary sexuality when there is no overlap between voice outputs is called the main sexuality, and the sexuality differing from the main sexuality earlier under voice output which is used to read the next text data is called the sub-sexuality (see FIG. 11). However, when the voice outputting of the next text data is to be effected during the voice output with the sub-sexuality, it is effected with the main sexuality.

Figure 8:
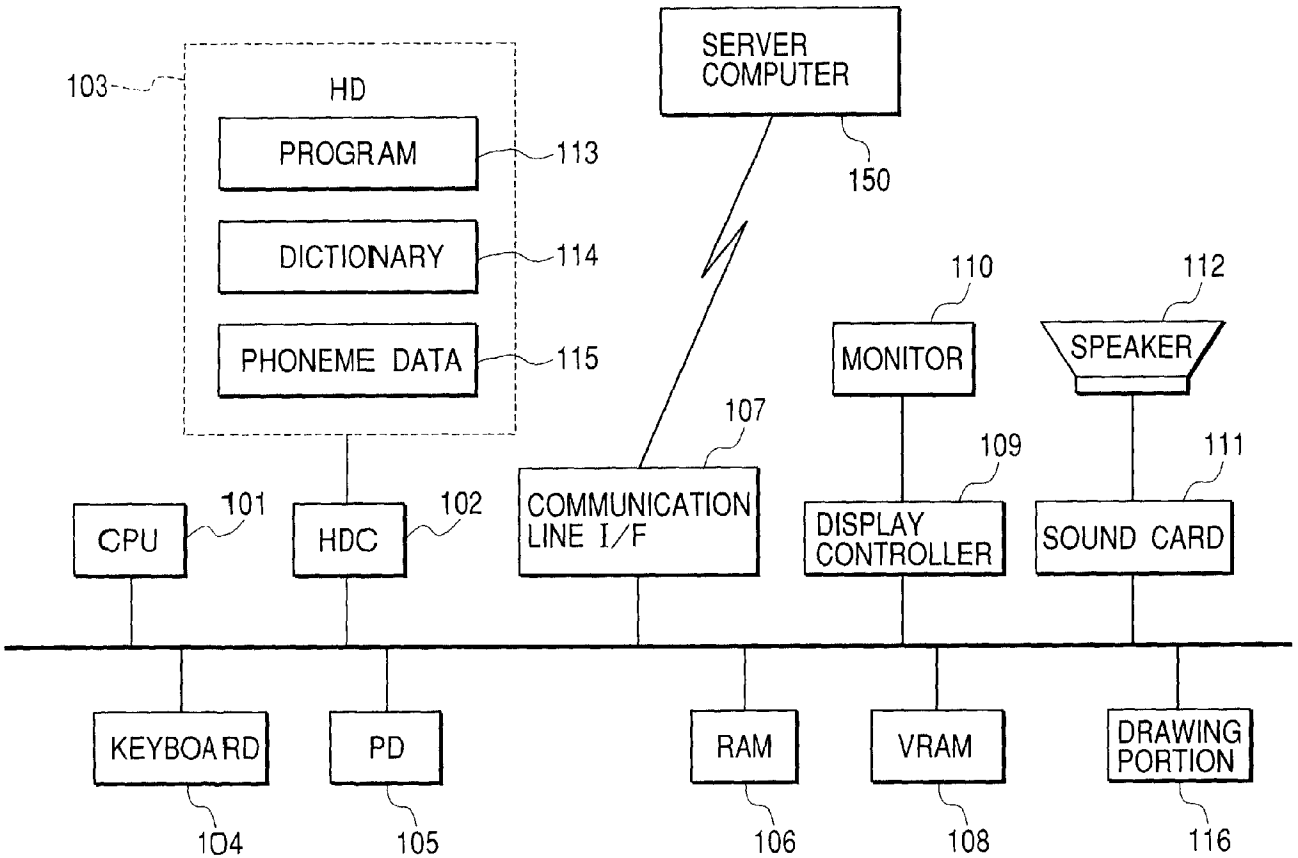
FIG. 8 is a block diagram schematically showing the construction of the voice synthesizing apparatus according to the embodiments (2, 4 and 5) of the present invention.

FIG. 8 is a block diagram showing an example of the construction of a voice synthesizing apparatus according to the second embodiment of the present invention. The voice synthesizing apparatus according to the second embodiment of the present invention is provided with a CPU 101, a hard disc controller (HDC) 102, a hard disc (HD) 103 having a program 113, a dictionary 114 and phoneme data 115, a keyboard 104, a pointing device (PD) 105, a RAM 106, a communication line interface (I/F) 107, VRAM 108, a display controller 109, a monitor 110, a sound card 111, a speaker 112 and a drawing portion 116. In FIG. 8, the reference numeral 150 designates a server computer.

The construction of each of the above-mentioned portions will be described in detail below. The CPU 101 is a central processing unit for effecting the control of the entire apparatus, and executes the processing shown in the flow chart of FIG. 10 which will be described later. The hard disc controller 102 effects the control of the data and program in the hard disc 103. In the hard disc 103, there are stored the program 113, the dictionary 114 in which are registered the Japanese equivalents of kanjis, etc. and accent information to be referred to when in a voice waveform generating portion (which will be described later), inputted sentences consisting of a mixture of kanjis; and kanas are analyzed to thereby obtain reading information, and the phoneme data 115 which become necessary when phonemes are to be connected together in accordance with rows of characters uttered. This phoneme data 115 includes at least two kinds of phoneme data, i.e., phoneme data which becomes the output of male voice and phoneme data which becomes the output of female voice. These two kinds of phoneme data differ in basic frequency from each other in accordance with sexuality.

The keyboard 104 is used for the inputting of characters, numerals, symbols, etc. The pointing device 105 is used to indicate the starting or the like of the program, and is comprised, for example, of a mouse, a digitizer, etc. The RAM 106 stores a program and data therein. The communication line interface 107 effects the exchange of data with the external server computer 150. In the present embodiment, TCP/IP (Transmission Control Protocol/Internet Protocol) is used as the communication form. The display controller 109 effects the control of outputting image data stored in the VRAM 108 as an image signal to the monitor 110. The sound card 111 outputs voice waveform data generated by the CPU 101 and stored in the RAM 106 through the speaker 112. The drawing portion 116 generates display image data to the monitor 110 by the use of the RAM 106, etc. under the control of the CPU 101.

The module relation of the program of the voice synthesizing apparatus according to the present embodiment is the same as that of FIG. 2 shown in Embodiment 1 and therefore need not be described.

Figure 9:
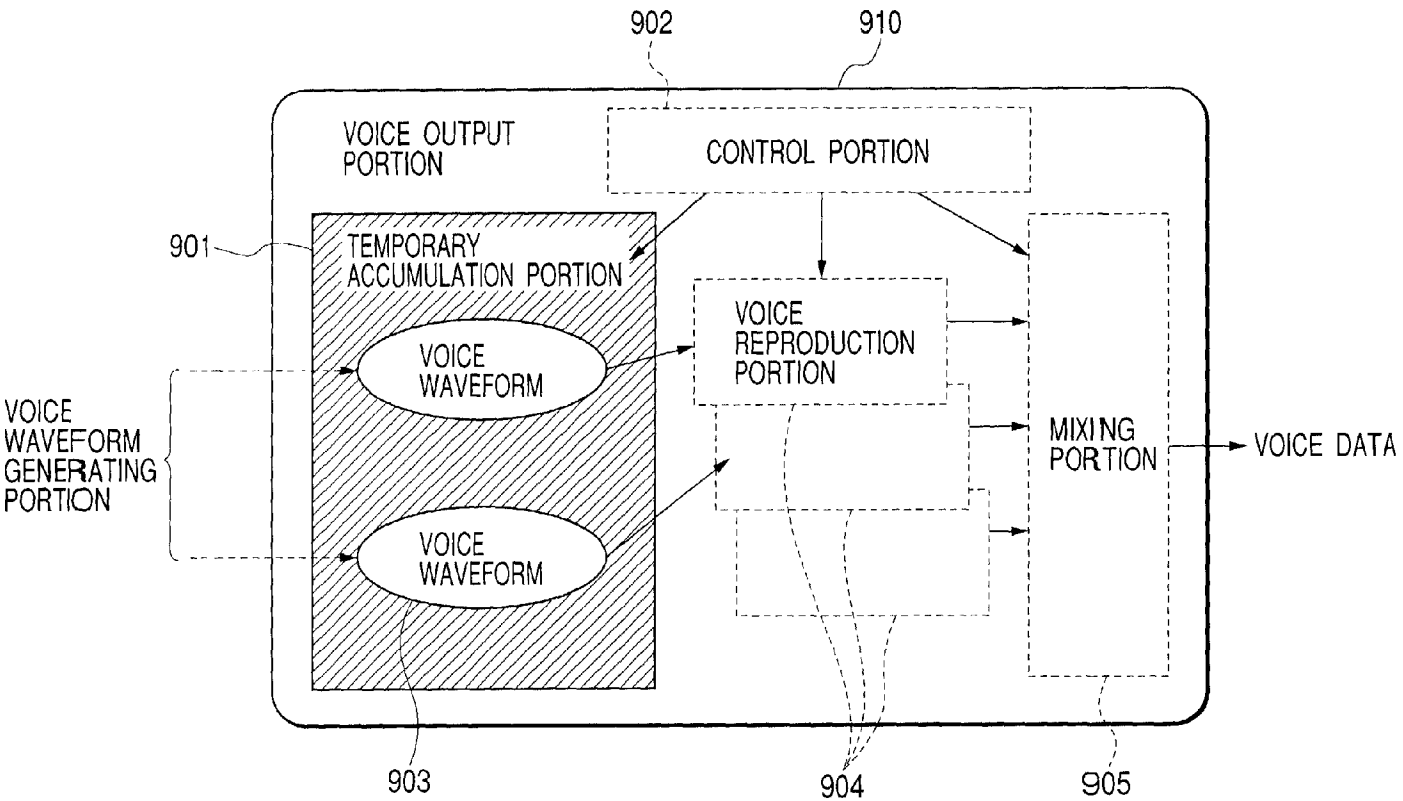
FIG. 9 is an illustration showing the detailed construction of a voice output portion in the module of the program of the voice synthesizing apparatus according to the embodiments (2 and 4 to 8) of the present invention.

FIG. 9 is an illustration showing the detailed construction of the voice output portion 210 (see FIG. 2) of the voice synthesizing apparatus according to the second embodiment of the present invention. The voice output portion 210 of the voice synthesizing apparatus according to the second embodiment of the present invention is provided with a temporary accumulation portion 901, a control portion 902, a voice reproduction portion 904 and a mixing portion 905. In FIG. 9, the reference numeral 903 denotes a voice waveform.

The function of each of the above-mentioned portions will be described in detail below. The temporary accumulation portion 901 temporarily accumulates therein the voice waveform 903 sent from a voice waveform generating portion 209. The control portion 902 serves to control the whole of the voice output portion 210, and normally checks up whether the voice waveform 903 has been sent to the temporary accumulation portion 901, and when the voice waveform 903 has been sent to the temporary accumulation portion, the control portion 902 sends it to the voice reproduction portion 904, which thus starts voice reproduction.

The voice reproduction portion 904 executes the reproduction of the voice waveform 903 in accordance with a preset parameter (such as a sampling rate or the bit number of the data) necessary for the voice output from the output parameter 213 of FIG. 2.

At least two voice reproduction portions 904 exist, and when the voice waveform 903 has been sent, the control portion 902 sends the voice waveform 903 to the voice reproduction portion 904 that is not being used at that point of time, and executes reproduction. Also, the voice reproduction portion 904 may be constructed as a software-like process, and the control portion 902 maybe of such a construction as generates the process of the voice reproduction portion 904 each time the voice waveform 903 is sent, and extinguishes the process of that voice reproduction portion 904 at a point of time whereat the reproduction of the voice waveform 903 has ended.

Individual voice data outputted by the voice reproduction portions 904 are sent to the mixing portion 905 having at least two input portions, and the mixing portion 905 synthesizes the voice data and outputs final synthetic voice data from the speaker 112 of FIG. 8. At this time, the control portion 902 effects the level adjustment of mixing to the mixing portion 905 in conformity with the number of the voice data sent to the mixing portion 905.

The control portion 902 also has the function of receiving inquiry as to whether the voice is under output from the voice waveform generating portion 209, examining the operating situations of the voice reproduction portions 904 and the mixing portion 905, and returning the result to the voice waveform generating portion 209. The control portion 902 further has the function of receiving inquiry as to with what sexuality the voice is under output from the voice waveform generating portion 209, examining the data of the voice waveform under reproduction in the voice reproduction portion 904, and returning the result to the voice waveform generating portion 209.

The operation of the voice synthesizing apparatus according to the second embodiment of the present invention constructed as described above will now be described in detail with reference to FIGS. 10 and 12. The following processing is executed under the control of the CPU 101 shown in FIG. 8.

Figure 10:
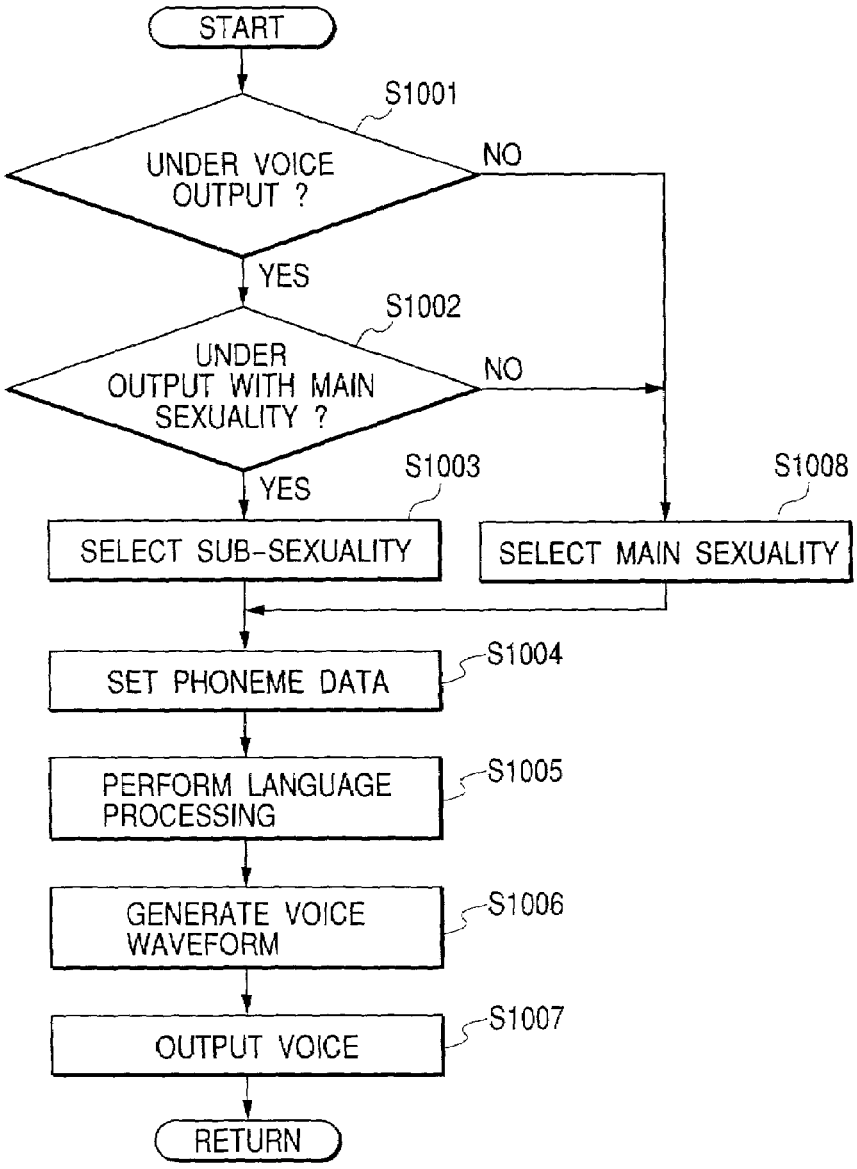
FIG. 10 is a flow chart showing the processing by the voice waveform generating portion of the voice synthesizing apparatus according to the embodiment (2) of the present invention.

FIG. 10 is a flow chart showing the process of voice-outputting text data sent from the communication data processing portion 204 of the voice synthesizing apparatus to the voice waveform generating portion 209. First, at a step S1001, whether a voice is presently under output is inquired of the control portion 902 of the voice output portion 210. If as the result, no voice is under output, at a step S1008, the sexuality of voice is set to the main sexuality (e.g. male), and advance is made to a step S1004.

If at the step S1001, a voice is presently under output, at a step S1002, whether the voice presently under output is the main sexuality or the sub-sexuality is inquired of the control portion 902 of the voice output portion 210, and if the voice presently under output is the main sexuality (e.g. male), at a step S1003, the sexuality of the voice is set to the sub-sexuality (e.g. female). If at the step S1002, the voice presently under output is the sub-sexuality (e.g. female), at a step S1008, the sexuality of the voice is set to the main sexuality (e.g. male).

At the step S1004, phoneme data of appropriate sexuality is selected from among pheneme data 115 in accordance with the sexuality of the voice changed over at the step S1003 or the step S1008. At a step S1005, the language analysis of the text data is performed by the use of the dictionary 114, and the Japanese equivalents and tone components of the text data are generated. Further, at a step S1006, a voice waveform is generated by the use of the pheneme data selected at the step S1004 in accordance with a parameter conforming to the sexuality selected at the step S1003 or S1008 of preset parameters regarding voice height (frequency band), accent (voice level), utterance speed, etc. contained in an acoustic parameter 212, and the Japanese equivalents and tone components of the text data analyzed at the step S1005. That is, when the main sexuality is selected, a voice waveform is generated in accordance with a parameter corresponding to the main sexuality, and when the sub-sexuality is selected, a voice waveform is generated in accordance with a parameter corresponding to the sub-sexuality.

At a step S1007, the voice waveform generated at the step S1006 is delivered to the voice output portion 210 and voice outputting is effected. When the voice waveform is sent to the voice output portion 210, the reproduction of the voice is performed by the use of one of the voice reproduction portions 904, but when there is a voice presently under reproduction by the voice reproduction portions 904, the newly delivered voice is mixed with the voice presently under reproduction by the mixing portion 905 and voice outputting is effected. If there is no voice presently under reproduction, the reproduced voice passes through the mixing portion 905, but is not processed in any way and intact voice outputting is effected.

As described above, when the overlapping of a plurality of voice outputs is detected, these voices are outputted in voices of different sexuality, whereby even if a plurality of voices overlap each other, they can be heard easily.

Figure 12:
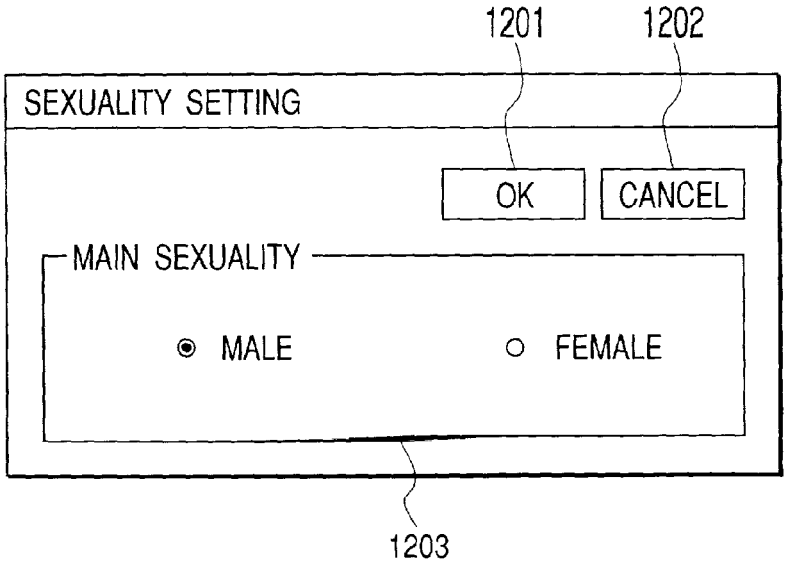
FIG. 12 is an illustration showing the sexuality setting mode screen of the voice synthesizing apparatus according to the embodiment (2) of the present invention.

FIG. 11 is a conceptual view showing the time relation between the output voice with the main sexuality and the output voice with the sub-sexuality in the voice synthesizing apparatus, and FIG. 12 is an illustration showing a method of setting the main sexuality in the voice synthesizing apparatus.

When there are instructions for a voice output setting screen by the keyboard 104 or the PD 105, the CPU 101 generates the image data of the setting screen shown in FIG. 12 by the use of the drawing portion 116, and displays it on the monitor 110 by the display controller 109.

Then, the user selects the main sexuality from male and female by the setting screen (setting means) 1203 of FIG. 12 by the use of the PD 105. By depressing "OK" button 1201, the variable of the main sexuality stored on the RAM 106 of FIG. 1 is rewritten, and the selection is completed. Also, when "cancel" button 1202 is depressed, the variable of the main sexuality stored on the RAM 106 is not rewritten, and the selection is cancelled and the sexuality setting mode is terminated. As regards the sub-sexuality, the sexuality opposite to the main sexuality is automatically selected.

As described above, according to the voice synthesizing apparatus according to the second embodiment of the present invention, there is achieved the effect that the overlap of a plurality of voice outputs is detected and respective voices are outputted in voices of different sexes, whereby hearing becomes easy.

If the second embodiment is used, there will be achieved the effect that for example, in a chat system wherein a plurality of user terminals connected by Internet make conversation by text data through a server computer, when text data which is other user's utterance sent from the server computer is voice-outputted, hearing can be made easy when the voice outputs of the text data from the plurality of users overlap one another.

Third Embodiment

A third embodiment of the present invention is a system for voice-outputting text data non-synchronously sent from other computer (server computer), wherein before the voice output of a text datum is terminated, when the next text data is sent, the outputs of a synthetic voice earlier under output and the next synthetic voice are reproduced by different speakers.

That is, when there is not the overlap of voice outputs, voice is outputted by the use of both of two stereospeakers usually connected to the computer (the same voices are reproduced by both of the two speakers), and when the voices overlap each other, the respective voices are outputted by the use of one of the two speakers (a first voice is reproduced from one speaker and the next voice is reproduced from the other speaker) (see FIG. 11). In the present embodiment, two or more voices are supposed on the premise that they do not overlap each other, but in the case of a system in which voices can be discretely reproduced by three or more speakers, even if a third voice, a fourth voice, etc. overlap one another, it is possible to cope with it.

Figure 13:
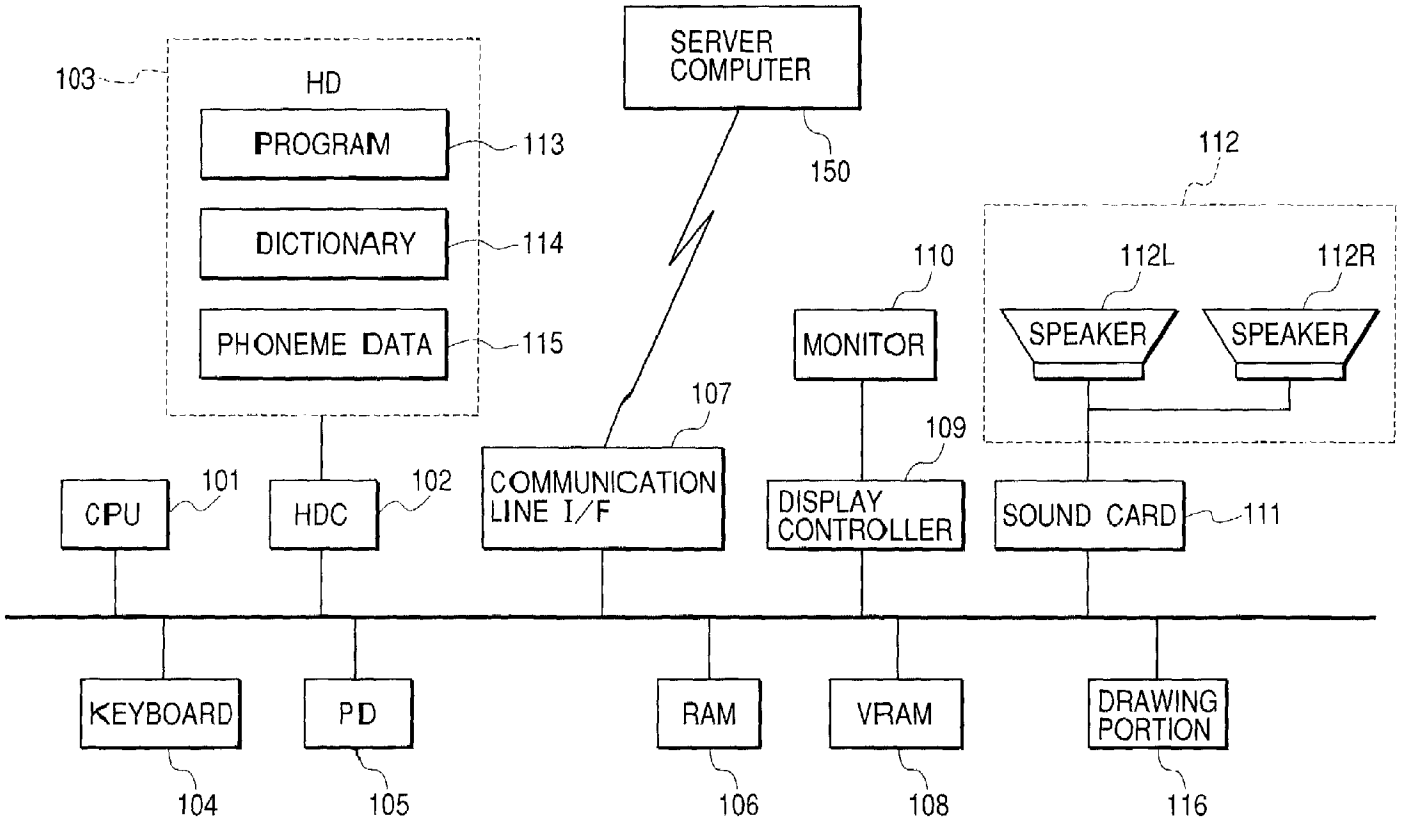
FIG. 13 is a block diagram schematically showing the construction of the voice synthesizing apparatus according to the embodiment (3) of the present invention.

FIG. 13 is a block diagram schematically showing the construction of a voice synthesizing apparatus according to the third embodiment of the present invention. The voice synthesizing apparatus according to the third embodiment of the present invention is provided with a CPU 101, a hard disc controller (HDC) 102, a hard disc (HD) 103 having a program 113, a dictionary 114 and phoneme data 115, a keyboard 104, a pointing device (PD) 105, a RAM 106, a communication line interface (I/F) 107, VRAM 108, a display controller 109, a monitor 110, a sound card 111, a speaker 112 (uttering means) having a right speaker 112R and a left speaker 112L, and a drawing portion 116.

Describing the differences of the third embodiment from the above-described first embodiment, the CPU 101 executes the processing shown in the flow chart of FIG. 15 which will be described later. The sound card 111 outputs voice waveform data generated by the CPU 101 and stored in the RAM 106 through the speaker 112 (the right speaker 112R and the left speaker 122L). In the other points, the construction of the voice synthesizing apparatus is similar to that of the above-described first embodiment and need not be described.

The module relation of the program of the voice synthesizing apparatus according to the third embodiment of the present invention is the same as that of FIG. 2 shown in Embodiment 1 and therefore need not be described.

Figure 14:
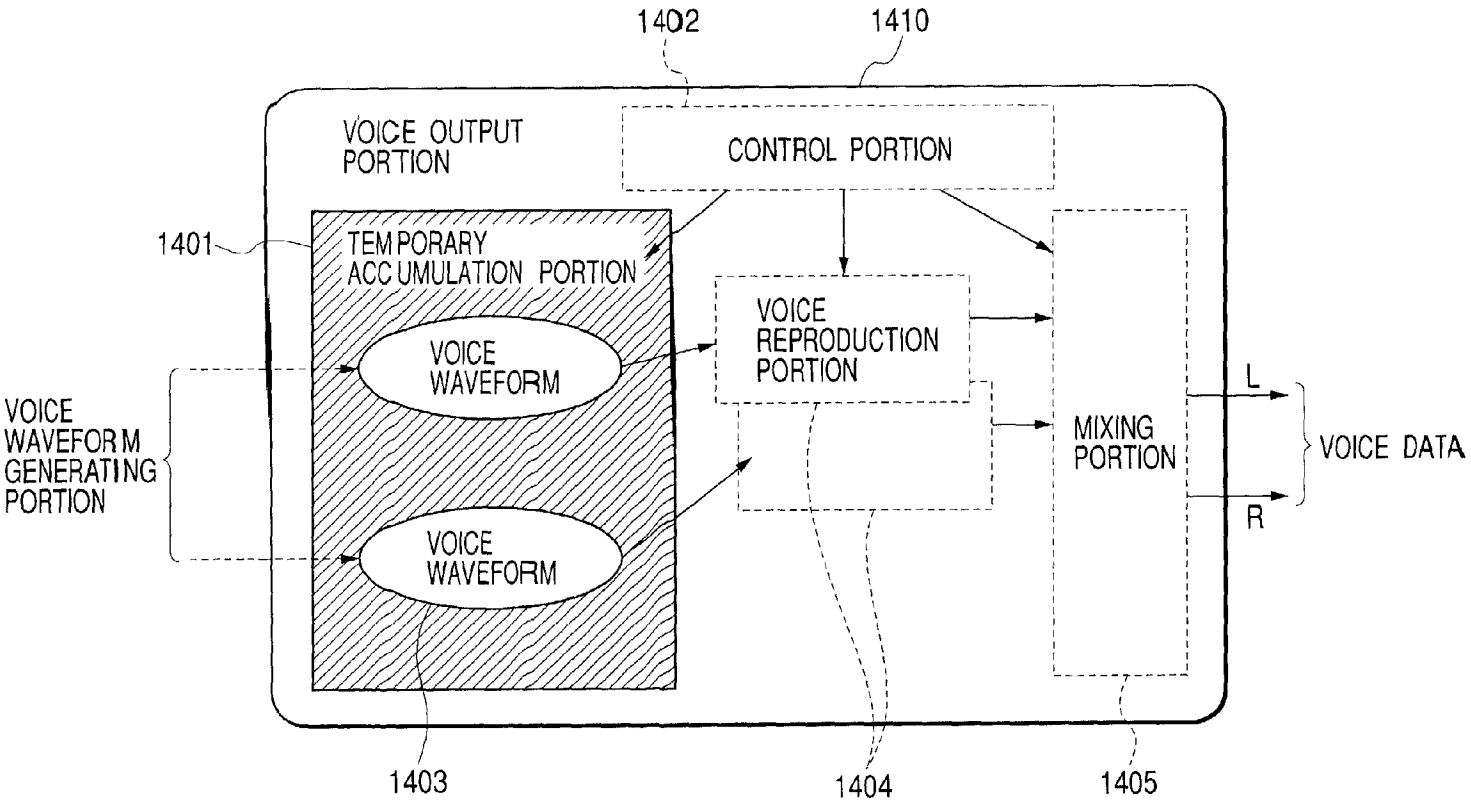
FIG. 14 is an illustration showing the detailed construction of a voice output portion in the module of the program of the voice synthesizing apparatus according to the embodiment (3) of the present invention.

FIG. 14 is an illustration showing the detailed construction of a voice output portion 210 in the module of the program of the voice synthesizing apparatus according to the third embodiment of the present invention. The voice output portion 210 of the voice synthesizing apparatus according to the third embodiment of the present invention is provided with a temporary accumulation portion 1401, a control portion 1402, a voice reproduction portion 1404 and a mixing portion 1405.

Describing the differences of the third embodiment from the above-described second embodiment, two voice reproduction portions 1404 exist, and when a voice waveform 1403 has been sent, the control portion 1402 sends the voice waveform 1403 to the voice reproduction portion 1404 which is not being used at that point of time, and executes reproduction. Individual voice data outputted by the voice reproduction portions 1404 are sent to the mixing portion 1405 having two input portions, and the mixing portion 1405 synthesizes the voice data, and outputs final synthetic voice data from the speaker 112 (the right speaker 112R and the left speaker 112L) shown in FIG. 13.

At this time, the mixing portion 1405 can control each of the voices outputted to the two speakers 112R and 112L of the speaker 112, and the control portion 1402 is designed to be capable of effecting the control of these speaker outputs to the mixing portion 1405. In the other points, the construction of the voice output portion 210 is similar to that of the above-described second embodiment and need not be described.

In the present system, two speakers are used and therefore, two voices at maximum can be reproduced at a time, but in a system wherein three or more speakers can be individually controlled, voices overlapping even to the number of the controllable speakers can be coped with.

The operation of the voice synthesizing apparatus according to the third embodiment of the present invention constructed as described above will now be described in detail with reference to FIGS. 15 and 17. The following processing is executed under the control of the CPU 101 shown in FIG. 13.

Figure 15:
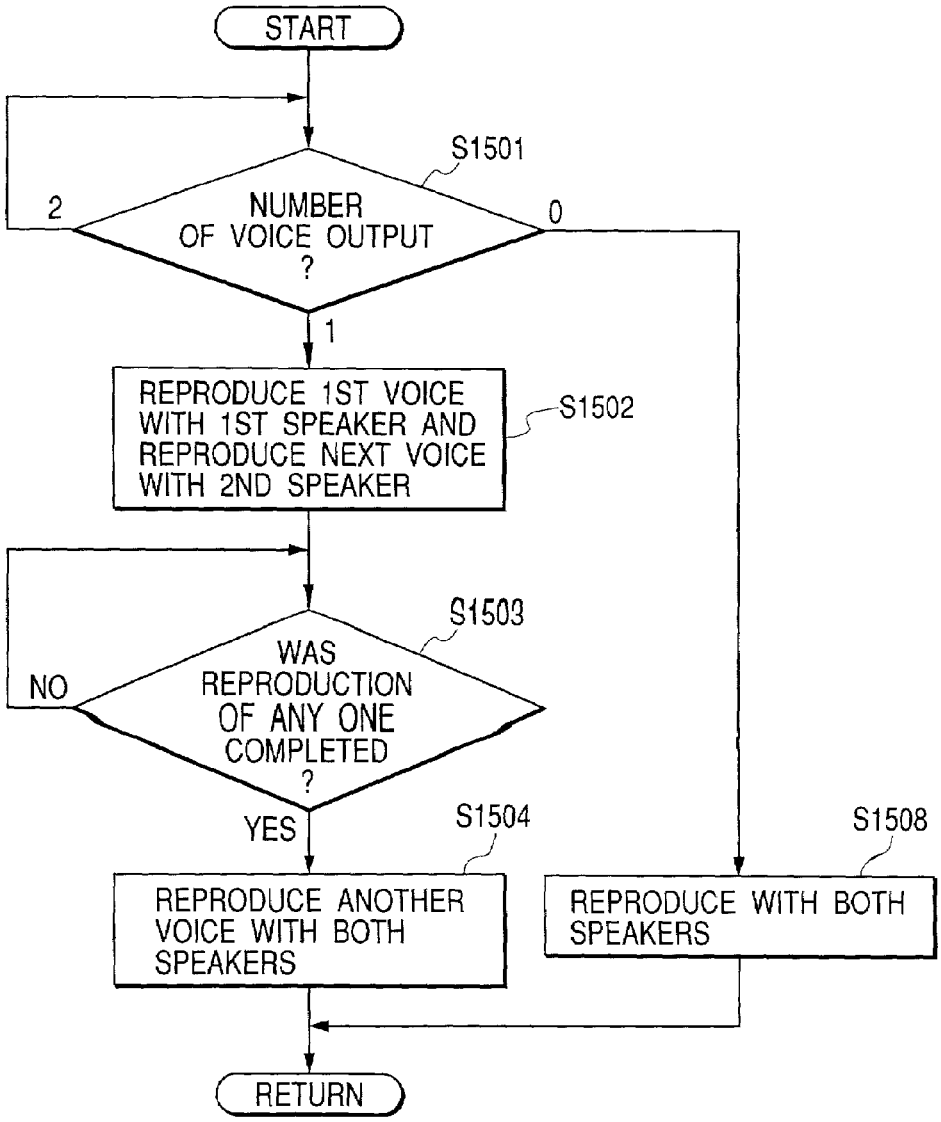
FIG. 15 is a flow chart showing the processing by the voice output portion of the voice synthesizing apparatus according to the embodiment (3) of the present invention.

FIG. 15 is a flow chart showing the processing from the time when a voice waveform has been sent from the voice waveform generating portion 209 of the voice synthesizing apparatus to the voice output portion 210 until a voice is outputted. First, at a step S1501, the control portion 1402 of the voice output portion 210 examines the operative state of the voice reproduction portions 1404, and confirms whether a voice is presently under output. If as the result, a voice is not under output, at a step S1508, the control portion 1402 instructs the mixting portion 1405 to reproduce this voice by the use of both speakers 112R and 112L, and executes the reproduction of the voice.

If at the step S1501, a voice is presently under output, advance is made to a step S1502, where the control portion 1402 instructs the mixing portion 1405 to reproduce the voice presently under voice reproduction by a first speaker (112R or 112L) and reproduce the next voice by a second speaker (112L or 112R), and executes voice reproduction. When the two voices have already been reproduced at the step S1501, return is made to the step S1501, where waiting is effected until the voices under output become one or less.

After at the step S1502, the reproduction of the two voices has been started, advance is made to a step S1503, where the termination of the reproduction of either voice is waited for. When the reproduction of either voice is terminated, at a step S1504, the control portion 1402 instructs the mixing portion 1405 to reproduce the other voice under reproduction by the use of both speakers 112R and 112L, and executes voice reproduction.

As described above, when the overlapping of two voice outputs has been detected, the respective voices are outputted by the different speakers 112R and 112L, whereby even if three or more kinds of voices overlap one another, it becomes possible to hear them.

In the case of a system in which voices can be individually reproduced by three or more speakers, if setting is made so as to allot a speaker in conformity with the condition under which voice outputs overlap one another, it will become possible to hear three or more kinds of voices even if they overlap one another.

Figure 16:
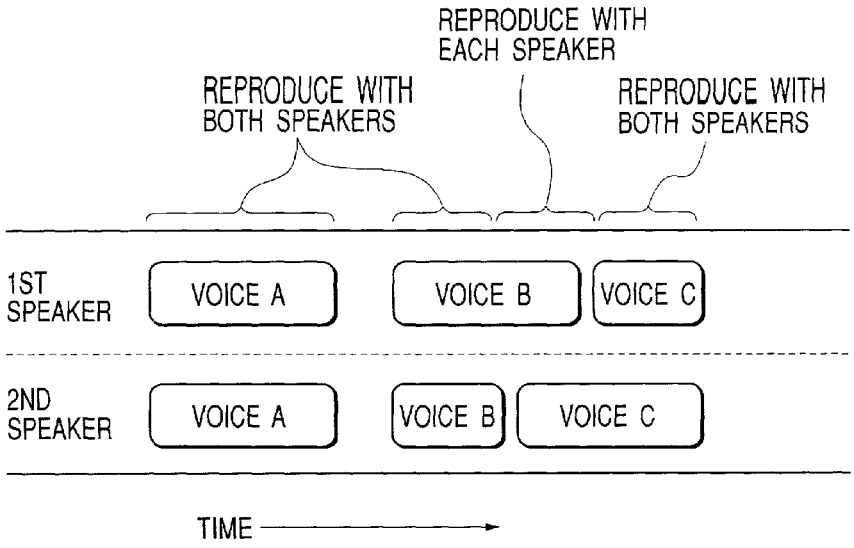
FIG. 16 is a conceptual view showing the time relation between the voices reproduced with both speakers and the voice reproduced with each speaker in the voice synthesizing apparatus according to the embodiment (3) of the present invention.
Figure 17:
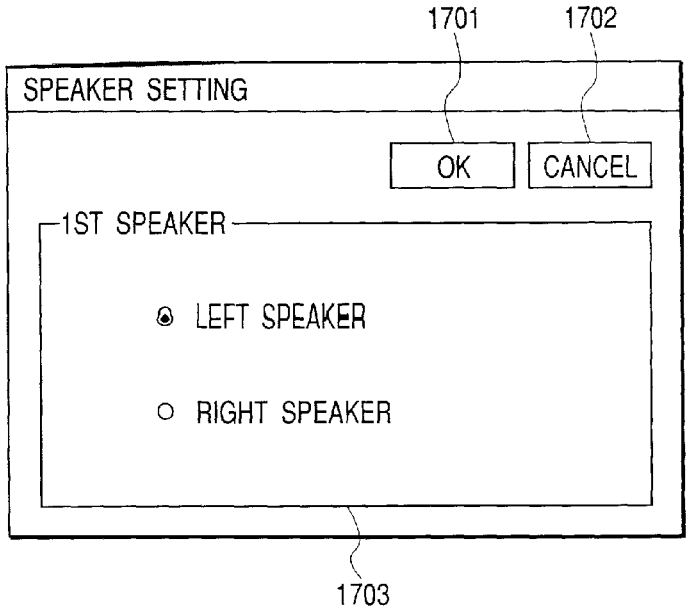
FIG. 17 is an illustration showing the speaker setting mode screen of the voice synthesizing apparatus according to the embodiment (3) of the present invention.

FIG. 16 is a conceptual view showing the time relation between the reproduced voice by both speakers and the reproduced voice by each speaker in the voice synthesizing apparatus, and FIG. 17 is an illustration showing a method of effecting the setting of the speakers in the voice synthesizing apparatus.

When there is the indication of a voice output setting screen by the keyboard 104 or the PD 105, the CPU 101 generates the image data of the setting screen shown in FIG. 17 by the use of the drawing portion 116, and displays it on the monitor 110 by the display controller 109.

Then, the user uses the PD 105 to select a speaker which outputs the first voice when voices overlap each other, by the setting screen (setting means) 1703 of FIG. 17, and depresses the "OK" button 1701, whereby the variable of the setting of the speaker for the first voice stored on the RAM 106 of FIG. 1 is rewritten, and the selection is completed.

At this time, the speaker for outputting the next voice is automatically set to the other speaker. Also, when the "cancel" button 1702 is depressed, the variable of the setting of the speaker stored on the RAM 106 is not rewritten, and the selection is cancelled and the speaker setting mode is terminated. When three or more speakers can be set, design can be made such that a speaker for the next voice can be selected in the same form as 1703.

As described above, according to the voice synthesizing apparatus according to the third embodiment of the present invention, there is achieved the effect that the overlapping of two voice outputs is detected and the respective voices are outputted by the discrete speakers 112R and 112L, whereby hearing becomes easy.

If this third embodiment is used, for example, in a chat system wherein a plurality of user terminals connected by Internet make conversation by text data through a server computer, there will be achieved the effect that when text data which is other user's utterance sent from the server computer is to be voice-outputted, hearing can be made easy when the voice outputs of text data from the plurality of users overlap one another.

Fourth Embodiment

A fourth embodiment of the present invention is a system for voice-outputting text data non-synchronously sent from other computer (server computer), wherein before the voice outputting of a text datum is terminated, when the next text data is sent, the next text data is read in a voice of a kind discrete from the voice earlier under voice output.

Figure 20:
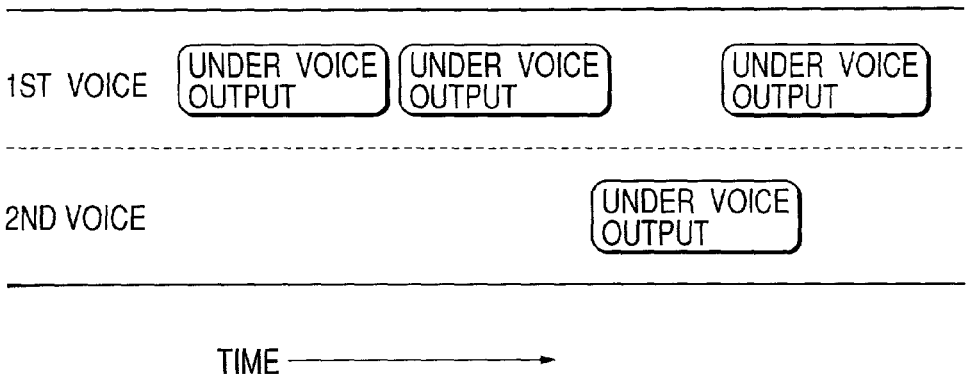
FIG. 20 is a conceptual view showing the time relation between the output voice in a first voice and the output voice in a second voice in the voice synthesizing apparatus according to the embodiment 4 of the present invention.

In the present embodiment, when there is not overlap between voice outputs, an ordinarily used voice is called a first voice, and a voice differing in kind from the first voice earlier under voice output which is used to read the next text data is called a second voice (see FIG. 20). In the present embodiment, thought is taken on the premise that two or more voices do not overlap each other, but further when voices are expected to overlap each other, a third voice and a fourth voice can be prepared.

A voice synthesizing apparatus according to the fourth embodiment of the present invention, like the above-described second embodiment, is provided with a CPU 101, a hard disc controller (HDC) 102, a hard disc (HD) 103 having a program 113, a dictionary 114 and phoneme data 115, a keyboard 104, a pointing device (PD) 105, a RAM 106, a communication line interface (I/F) 107, VRAM 108, a display controller 109, a monitor 110, a sound card 111, a speaker 112 and a drawing portion 116 (see FIG. 8).

Describing the differences of the fourth embodiment from the above-described second embodiment, the CPU 101 executes the processing shown in the flow charts of FIGS. 18 and 19 which will be described later. The phoneme data 115 includes at least two kinds of phoneme data differing in the nature of voice (for example, the phoneme data of a child's voice and the phoneme data of an old man's voice). It is to be understood that one voice (e.g. a child's voice) is set as the first voice and the other voice (e.g. an old man's voice) is set as the second voice. In the other points, the construction of the voice synthesizing apparatus is similar to that of the above-described second embodiment, and need not be described.

Also, the voice synthesizing apparatus according to the fourth embodiment of the present invention, like the above-described second embodiment, is provided with the dictionary 114, the phoneme data 115, a main routine initializing portion 201, a voice processing initializing portion 202, a communication data processing portion 204, a communication data storing portion 206, a display text data storing portion 207, a text display portion 208, a voice waveform generating portion 209 (voice waveform generating means), a voice output portion 210 (voice output means), a communication processing portion 211 having an initializing portion 203 and a receiving portion 205, phoneme data 115, an acoustic parameter 212 and an output parameter 213 (see FIG. 2). The construction of each portion of the program module of the voice synthesizing apparatus is similar to that in the above-described first embodiment, and need not be described.

Also, the voice output portion 210 of the voice synthesizing apparatus according to the fourth embodiment of the present invention, like that of the above-described second embodiment, is provided with a temporary accumulation portion 901, a control portion 902, a voice reproduction portion 904 and a mixing portion 905 (see FIG. 9).

Describing the differences of the fourth embodiment from the above-described second embodiment, at least two (actually a number by which syntheses are expected at a time) voice reproduction portions 904 exist, and when a voice waveform 903 has been sent, the control portion 902 sends the voice waveform 903 to the voice reproduction portion 904 which is not being used at that point of time, and executes reproduction. Individual voice data outputted by the voice reproduction portions 904 are sent to the mixing portion 905 having at least two (actually a number by which syntheses are expected at a time) input portions, and the mixing portion 905 synthesize the voice data and outputs final synthetic voice data from the speaker 112 shown in FIG. 8.

Also, the control portion 902 has the function of receiving from the voice waveform generating portion 209 inquiry about in what voice the voice data is under output, examining the data of the voice waveforms under reproduction by all voice reproduction portions 904 being used, and returning the result to the voice waveform generating portion 209. In the other points, the construction of the voice output portion 210 is similar to that in the above-described second embodiment and need not be described.

The operation of the voice synthesizing apparatus according to the fourth embodiment of the present invention constructed as described above will now be described in detail with reference to FIGS. 18, 19 and 21. The following processing is executed under the control of the CPU 101 shown in FIG. 8.

Figure 18:
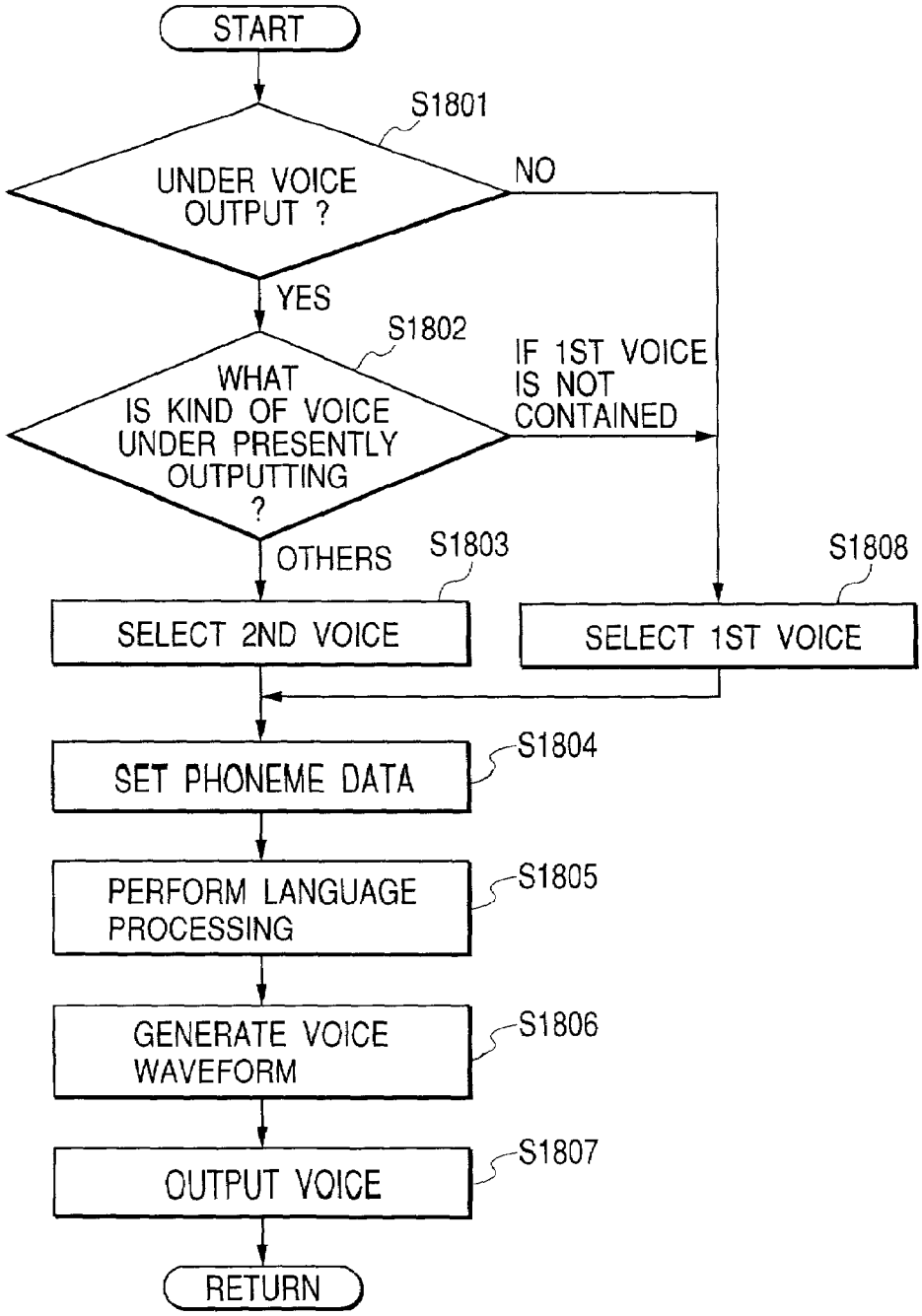
FIG. 18 is a flow chart showing the processing by the voice waveform generating portion of the voice synthesizing apparatus according to the embodiment (4) of the present invention.

FIG. 18 is a flow chart showing the process of voice-outputting text data sent from the communication data processing portion 204 of the voice synthesizing apparatus to the voice waveform generating portion 209. First, at a step S1801, whether a voice is presently under output is inquired of the control portion 902 of the voice output portion 210. If as the result, a voice is not under output, at a step S1808, the kind of the voice is set to the first voice (e.g. a child's voice), and advance is made to a step S1804.

If at the step S1801, a voice is presently under output, at a step S1802, the kind of the voice presently under output is inquired of the control portion 902 of the voice output portion 210, and if the first voice is not contained in the voice presently under output, at the step S1808, the kind of the voice is set to the first voice (e.g. a child's voice). In any other case, at a step S1803, the kind of the voice is set to the second voice (e.g. an old man's voice).

At a step S1804, phoneme data of an appropriate kind is selected from among the phoneme data 115 in accordance with the information of the kind of voice changed over at the step S1803 or the step S1808. At a step S1805, language analysis is performed by the use of the dictionary 114, and the Japanese equivalents and tone components of the text data are generated. Further, at a step S1806, in accordance with a parameter corresponding to the kind of the selected voice, of preset parameters regarding voice height, accent, utterance speed, etc. contained in the acoustic parameter 212, a voice waveform is generated by the use of the phoneme data selected at the step S1804 and the Japanese equivalents and tone components of the text data analyzed at the step S1805.

At a step S1807, the voice waveform generated at the step S1806 is delivered to the voice output portion 210 and voice outputting is effected. When the voice waveform is sent to the voice output portion 210, the reproduction of the voice is performed by the use of one of the voice reproduction portions 904, but when there is a voice presently under reproduction by the voice reproduction portions 904, the newly delivered voice is mixed with the voice presently under reproduction by the mixing portion 905 and voice outputting is effected. When there is no voice presently under reproduction, the reproduced voice passes through the mixing portion 905, but is subjected to no processing and intact voice outputting is effected.

As described above, when the overlapping of a plurality of voice outputs is detected, the respective voices are outputted in different kinds of voices, whereby even if a plurality of voices overlap each other, they can be heard easily.

Figure 19:
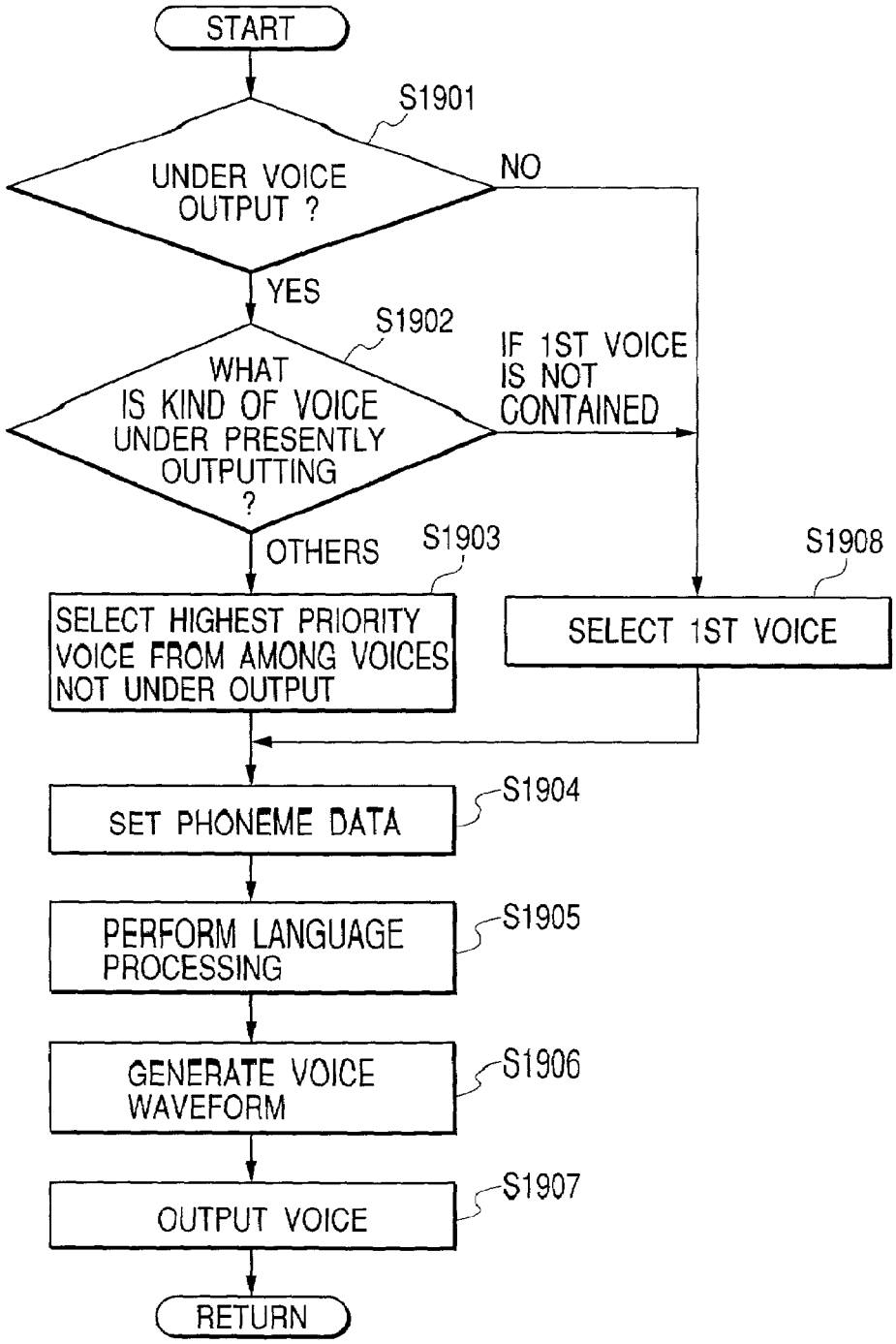
FIG. 19 is a flow chart showing the processing by the voice waveform generating portion of the voice synthesizing apparatus according to the embodiment (4) of the present invention.

There is the possibility of three or more kinds of voices overlapping one another and therefore, when a third and subsequent voices are also set, as shown in FIG. 19, at a step S1903, the highest priority voice not under output can be selected (in FIG. 19, the other portions than the step S1903 execute the entirely same processing as that in FIG. 18 and therefore need not be repeatedly described).

Figure 21:
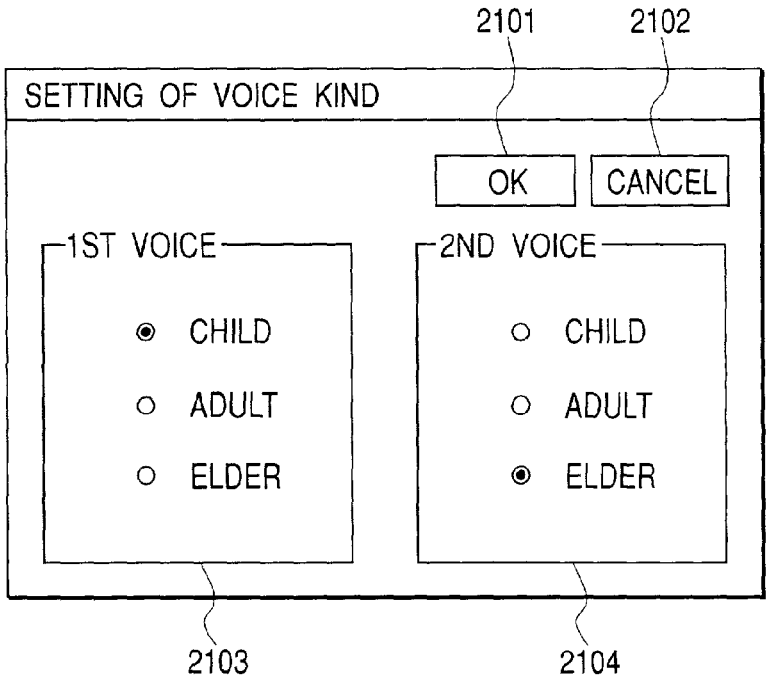
FIG. 21 is an illustration showing the voice kind setting mode screen of the voice synthesizing apparatus according to the embodiment (4) of the present invention.

FIG. 20 is a conceptual view showing the time relation between the output voice in the first voice and the output voice in the second voice in the voice synthesizing apparatus, and FIG. 21 is an illustration showing a method of setting the kinds of voices in the voice synthesizing apparatus.

When there is the indication of a voice output setting screen by the keyboard 104 or the PD 105, the CPU 101 generates the image data of the setting screen shown in FIG. 21 by the use of the drawing portion 116, and displays it on the monitor 110 by the display controller 109.

Then, the user uses the PD 105 to select a voice to be the first voice from among registered voices by the setting screen (setting means) 2103 of FIG. 21, and select a voice to be the second voice from among registered voices by the setting screen 2104 of FIG. 21. By depressing the "OK" button 2101, the variables of the setting of the first voice and second voice stored on the RAM 106 of FIG. 1 are rewritten and the selection is completed.

When the "cancel" button 2102 is depressed, the variables of the setting of the first voice and second voice stored on the RAM 106 are not rewritten, and the selection is cancelled and the voice kind setting mode is terminated. When there are a third and subsequent voices, design can be made such that the third voice, etc. can be selected in the same form as 2103 and 2104.

As described above, according to the voice synthesizing apparatus according to the fourth embodiment of the present invention, there is achieved the effect that the overlap of a plurality of voice outputs is detected and the respective voices are outputted in voices of different kindes, whereby hearing becomes easy.

If the present embodiment is used, for example, in a chat system wherein a plurality of user terminals connected by Internet make conversation by text data through a server computer, there will be achieved the effect that when text data which is other user's utterance sent from the server computer is to be voice-outputted, hearing can be made easy when the text data from the plurality of users overlap one another.

Fifth Embodiment

A fifth embodiment of the present invention is a system for voice-outputting text data non-synchronously sent from other computer (server computer), wherein before the voice outputting of a text datum is terminated, when the next text data is sent, the next text data is read at the height of a voice discrete from the voice earlier under voice output.

In the present embodiment, when there is no overlap between voice outputs, an ordinarily used voice is called a first height voice, and a voice differing from the first height voice earlier under voice output which is used to read the next data when the voices overlap each other is called a second height voice (see FIG. 2). In the present embodiment, thought is taken on the premise that two or more voices do not overlap each other, but further when the voices are expected to overlap each other, a third height voice, a fourth height voice, etc. can be prepared.

A voice synthesizing apparatus according to the fifth embodiment of the present invention, like the above-described fourth embodiment, is provided with a CPU 101, a hard disc controller (HDC) 102, a hard disc (HD) 103 having a program 113, a dictionary 114 and phoneme data 115, a keyboard 104, a pointing device (PD) 105, a RAM 106, a communication line interface (I/F) 107, VRAM 108, a display controller 109, a monitor 110, a sound card 111 and a speaker 112 (see FIG. 18).

Describing the difference of the fifth embodiment from the above-described fourth embodiment, the CPU 101 executes the processing shown in the flow charts of FIGS. 22 and 23 which will be described later. In the other points, the construction of the voice synthesizing apparatus according to the fifth embodiment is similar to that of the above-described fourth embodiment and need not be described.

Also, the voice synthesizing apparatus according to the fifth embodiment of the present invention, like the above-described third embodiment, is provided with the dictionary 114, the phoneme data 115, a main routine initializing portion 201, a voice processing initializing portion 202, a communication data processing portion 204, communication data storing portion 206, a display text data storing portion 207, a text display portion 208, a voice waveform generating portion 209 (voice waveform generating means), a voice output portion 210 (voice output means), a communication processing portion 211 having an initializing portion 203 and a receiving portion 205, the phoneme data 115, an acoustic parameter 212 and an output parameter 213 (see FIG. 8). The construction of each portion of the program module of the voice synthesizing apparatus is similar to that of the above-described third embodiment and need not be described.

Also, the voice output portion 210 of the voice synthesizing apparatus according to the fifth embodiment of the present invention, like that in the above-described fourth embodiment, is provided with a temporary accumulation portion 901, a control portion 902, voice reproduction portions 904 and a mixing portions 905 (see FIG. 9).

Describing the differences of the fifth embodiment from the above-described four the embodiment, the voice reproduction portions 904 have the function of freely adjusting the height of voice during reproduction in accordance with the instructions of the control portion 902. The adjustment of the height of voice, when for example, it is desired to make a voice high, becomes possible by strongly outputting the frequency area of a high voice, of the frequency components of a voice reproduced, and weakening the other frequency areas. Also, the control of detecting the overlap of voice outputs, and changing the action thereto, i.e., the height of voice, is all performed by the voice output portion 210. In the other points, the construction of the voice output portion 210 is similar to that in the above-described fourth embodiment and need not be described.

The operation of the voice synthesizing apparatus according to the fifth embodiment of the present invention constructed as described above will now be described in detail with reference to FIGS. 22, 23 and 25. The following processing is executed under the control of the CPU 101 shown in FIG. 8.

Figure 22:
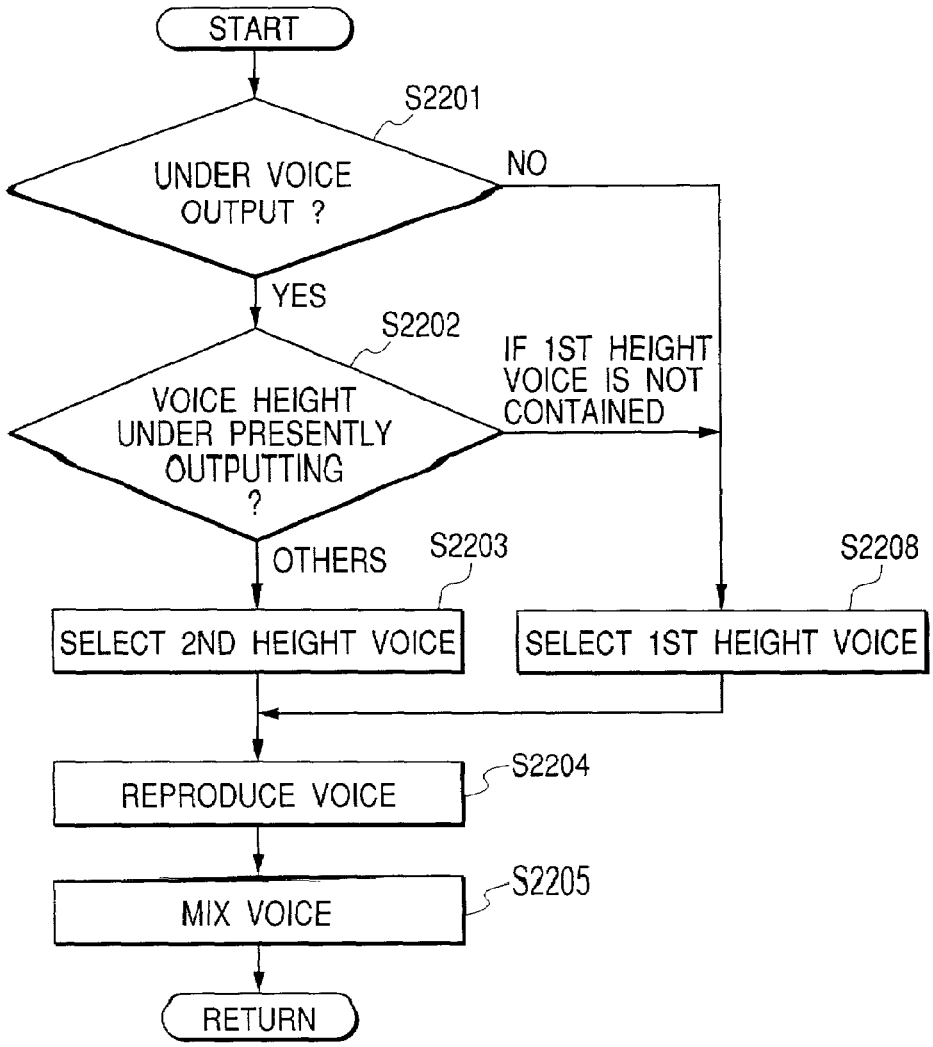
FIG. 22 is a flow chart showing the processing by the voice output portion of the voice synthesizing apparatus according to the embodiment (5) of the present invention.

FIG. 22 is a flow chart showing the processing from the time when a voice waveform has been sent from the voice waveform generating portion 209 of the voice synthesizing apparatus to the voice output portion 210 until a voice is outputted. First, at a step S2201, the control portion 902 of the voice output portion 210 examines the operative state of the voice reproduction portion 904, and confirms whether a voice is presently under output. If as the result, a voice is not under output, at a step S2208, the voice is set to the first height voice, and advance is made to a step S2204.

If at the step S2201, a voice is presently under output, at a step S2202, the control portion 902 inquires the height of the voice presently under output of the voice reproduction portion 904 presently reproducing a voice, and if as the result, the first height voice is not contained in the voice presently under reproduction, at the step S2208, the voice is set to the first height voice. In any other case, at a step S2203, the voice is set to the second height voice.

At the step S2204, the reproduction of the voice waveform is effected by the use of one of the voice reproduction portions 904, and here, the reproduction is executed with the height of the voice adjusted in accordance with the information of the height of the voice set at the step S2203 or the step S2208. The reproduced voice is subjected to the mixing of voices at a step S2205, and becomes the output of the final voice. When at this time, there is other voice presently under reproduction by the voice reproduction portion 904, the newly reproduced voice is mixed with the voice presently under reproduction by the mixing portion 905 and voice outputting is effected. If there is no voice presently under reproduction, the reproduced voice passes through the mixing portion 905, but is not processed in any way and intact voice outputting is effected.

As described above, when the overlapping of a plurality of voice outputs is detected, the respective voices are outputted in voices of different heights, whereby even if a plurality of voices overlap each other, they can be heard easily.

Figure 23:
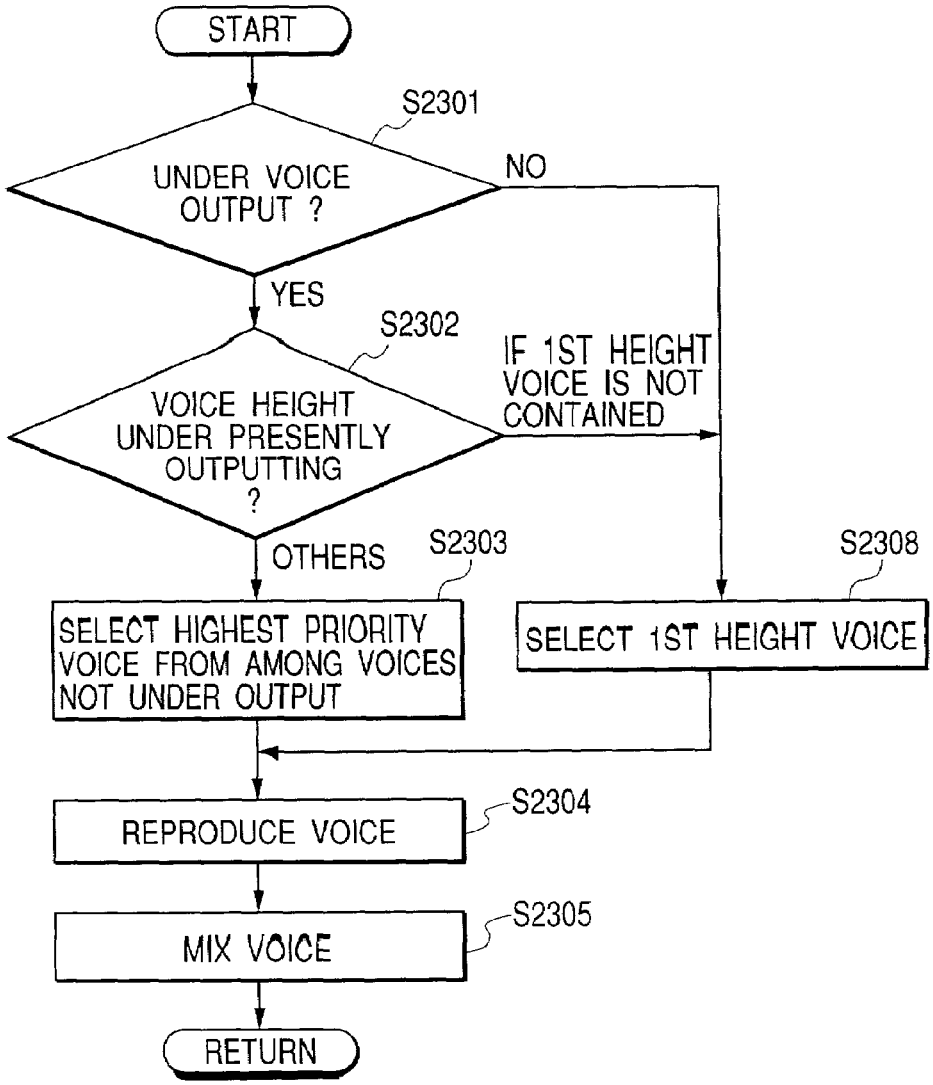
FIG. 23 is a flow chart showing the processing by the voice output portion of the voice synthesizing apparatus according to the embodiment (5) of the present invention.

When the third height voice and subsequent voices are also set because there is the possibility of three or more kinds of voices overlapping one another, as shown in FIG. 23, at a step S2303, the highest priority voice not under output can be selected (in FIG. 23, the other portions than the step S2303 perform the entirely same processing as that in FIG. 22 and therefore need not be repeatedly described).

Figure 24:
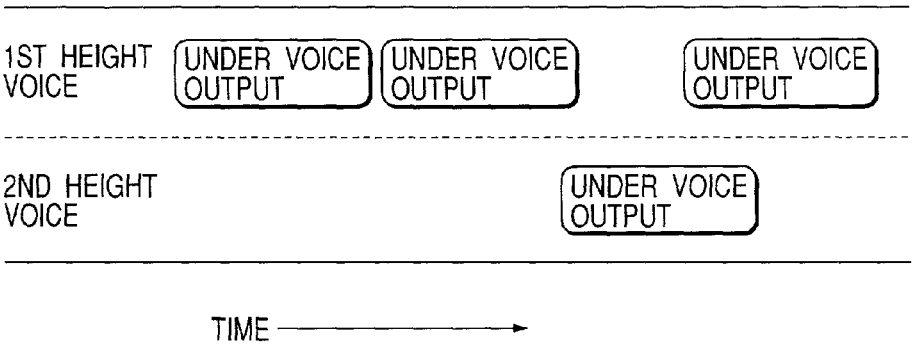
FIG. 24 is a conceptual view showing the time relation between the output voice in a first height voice and the output voice in a second height voice in the voice synthesizing apparatus according to the embodiment (5) of the present invention.
Figure 25:
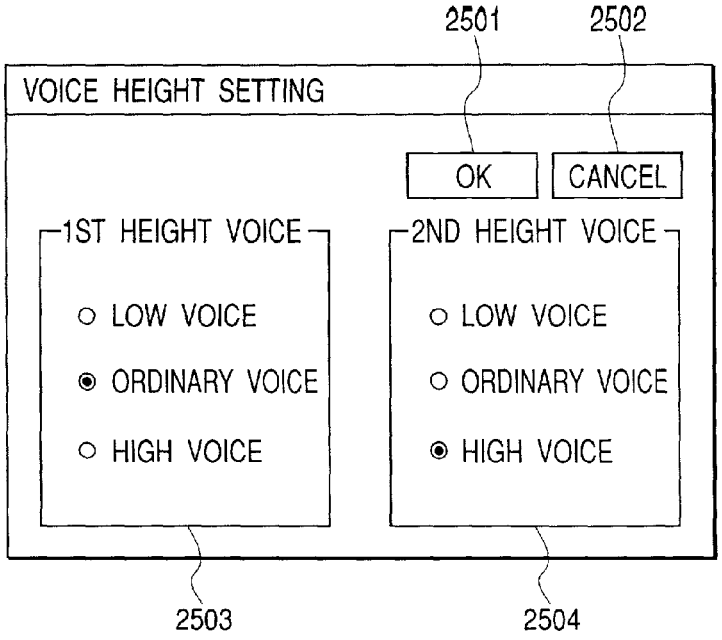
FIG. 25 is an illustration showing the voice height setting mode screen of the voice synthesizing apparatus according to the embodiment (5) of the present invention.

FIG. 24 is a conceptual view showing the time relation between the output voice in the first height voice and the output voice in the second height voice in the voice synthesizing apparatus, and FIG. 25 is an illustration showing a method of setting the height of voice in the voice synthesizing apparatus.

When there is the indication of a voice output setting screen by the keyboard 104 or the PD 105, the CPU 101 generates the image data of a setting screen shown in FIG. 25 by the use of the drawing portion 116, and displays it on the monitor 110 by the display controller 109.

Then, the user uses the PD 105 to select the first height voice from among registered voices by the setting screen (setting means) 2503 of FIG. 25, and select the second height voice from among the registered voices by the setting screen 2504 of FIG. 25. By depressing "OK" button 2501, the variables of the setting of the first height voice and second height voice stored on the RAM 106 of FIG. 1 are rewritten, and the selection is completed.

Also, when "cancel" button 2502 is depressed, the variables of the setting of the first height voice and second height voice stored on the RAM 106 are not rewritten, and the selection is cancelled and the voice height setting mode is terminated. When there are a third height voice and subsequent voices, design can be made such that the third height voice, etc. can be selected in the same form as the above-described 2503 and 2504.

As described above, according to the voice synthesizing apparatus according to the fifth embodiment of the present invention, there is achieved the effect that the overlap of a plurality of voice outputs is detected and the respective voices are outputted in voices of different heights, whereby hearing becomes easy.

If the present embodiment is used, for example, in a chat system wherein a plurality of user terminals connected by Internet make conversation by text data through a server computer, there will be achieved the effect that when text data which is other user's utterance sent from the server computer is to be voice-outputted, hearing can be made easy when text data from the plurality of users overlap each other.

As described above, there is achieved the effect that there can be provided a voice output apparatus in which when the synthetic voices of a plurality of text data are to be superimposed and uttered, the plurality of text data are voice-synthesized and outputted in different kinds of voices and therefore, the voices of the plurality of text data can be heard out easily.

Also, there is achieved the effect that there can be provided a voice output apparatus in which when the synthetic voices of a plurality of text data are to be superimposed and uttered, the voices of the plurality of text data are uttered by different uttering means and therefore, the voices of the plurality of text data can be heard out easily.

Also, there is achieved the effect that even in a system for making convers action by text data through Internet, as described above, the voices of a plurality of text data can be heard out easily.

Sixth Embodiment

A sixth embodiment of the present invention is a system for voice-outputting text data non-synchronously sent from other computer (server computer), wherein before the voice outputting of a text datum is terminated, when the next text data is sent, the text data is outputted with the utterance speed of the voice earlier under output increased.

The construction of the voice synthesizing apparatus according to the sixth embodiment is the same as that of the first embodiment (see FIGS. 1 and 2) and therefore need not be described.

The basic construction of the voice output portion 210 according to the sixth embodiment is the same as that shown in FIG. 9 and therefore will hereinafter be described with reference to FIG. 9.

The voice output portion 210 of the voice synthesizing apparatus according to the sixth embodiment is provided with a temporary accumulation portion 901, a control portion 902 and voice reproduction portions 904. In FIG. 9, the reference numeral 903 designates voice waveforms.

The function of each of the above-mentioned portions will now be described in detail. The temporary accumulation portion 901 temporarily accumulates therein the waveforms 903 sent from the voice waveform generating portion 209. The control portion 902 serves to control the whole of the voice output portion 210, and normally checks up whether the voice waveforms 903 have been sent to the temporary accumulating portion 901, and when the voice waveforms 903 have been sent to the temporary accumulation portion 901, the control portion 902 sends them to the voice reproduction portions 904 in the order of arrival thereof and causes the voice reproduction portions 904 to execute voice reproduction. If at this time, voice reproduction is being executed by the voice reproduction portions 904, the control portion 902 waits for the reproduction to be terminated, and then starts the next voice reproduction.

The voice reproduction portions 904 execute the reproduction of the voice waveforms 903 in accordance with preset parameters (such as a sampling rate and the bit number of data) necessary for voice output from the output parameter 213 of FIG. 2, and the reproduced voice data is outputted from the speaker 112 of FIG. 1. The voice reproduction portions 904 are designed to be capable of adjusting the speed of voice reproduction in accordance with the instructions from the control portion 902.

The operation of the voice synthesizing apparatus according to the sixth embodiment of the present invention constructed as described above will now be described in detail with reference to FIG. 26. The following processing is executed under the control of the CPU 101 shown in FIG. 1.

Figure 26:
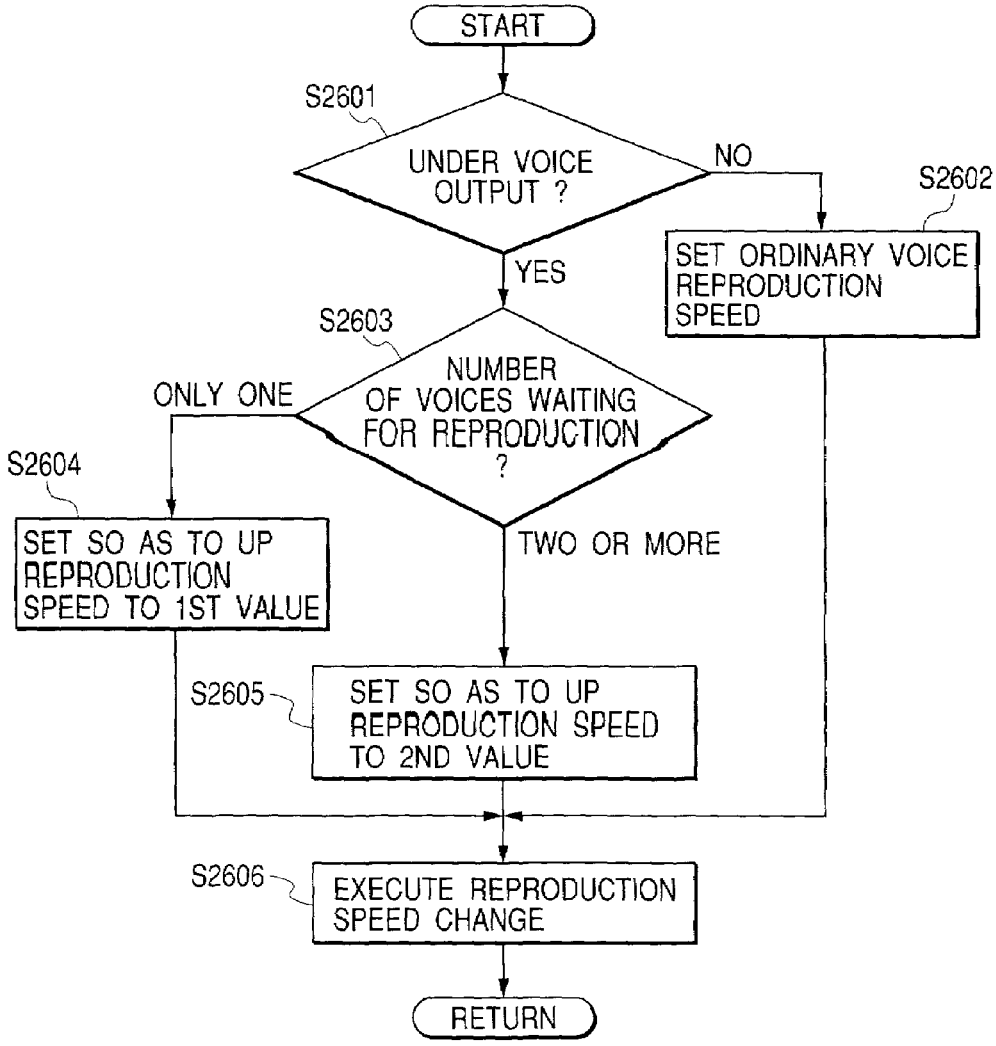
FIG. 26 is a flow chart showing the process of adjusting a voice reproduction speed executed when a voice waveform is sent from the voice waveform generating portion of the voice synthesizing apparatus according to the embodiment (6) of the present invention to a voice output portion.

FIG. 26 is a flow chart regarding the process of adjusting the voice reproduction speed which is executed when a voice waveform has been sent from the voice waveform generating portion 209 of the voice synthesizing apparatus to the voice output portion 210. When a voice waveform has been sent from the voice waveform generating portion 209 to the voice output portion 210, first at a step S2601, the control portion 902 of the voice output portion 210 examines the operative state of the voice reproduction portions 904 and confirms whether a voice is presently under output. If as the result, a voice is not under output, at a step S2602, the voice reproduction speed is set to an ordinary speed. If a voice is presently under output, advance is made to a step S2603, where the control portion 902 examines how many voice waveforms waiting for reproduction exist in the temporary accumulation portion 901.

If as the result, the number of the voice waveforms waiting for reproduction is only one (i.e., only the voice waveform which has just been sent), advance is made to a step S2604, where the voice reproduction speed is set to a set value upped to a predetermined first value. On the other hand, if there are two or more voice waveforms waiting for reproduction (that is, there is one or more voice waveforms waiting for reproduction besides the voice waveform which has just been sent), advance is made to a step S2605, where the voice reproduction speed is set to a set value upped to a second value set to a value higher than the predetermined first value.

Thereafter, advance is made to a step S2606, where the setting to the reproduction speeds set at the step S2602, the step S2604 and the step S2605 are executed from the control portion 902 to the voice reproduction portions 904. Thereby, from that point of time, the speed of voice waveform reproduction changes.

If as the result of the processing shown in the flow chart of FIG. 26, a voice is not presently under output, the voice is reproduced at the ordinary reproduction speed (this is a change in the reproduction speed from that point of time and therefore, in this case, the reproduction speed of the voice waveform 903 which has just been sent to the voice output portion 210 is the ordinary reproduction speed), and if there is a voice waveform presently under reproduction, but there is only one voice waveform waiting for reproduction, it is reproduced at a little higher reproduction speed (this is a change in the reproduction speed from that point of time and therefore, in this case, the reproduction speed of the voice waveform 903 presently under reproduction becomes a little higher), and if there is a voice waveform presently under reproduction and there are two or more voice waveforms waiting for reproduction, reproduction is effected at still a higher reproduction speed (this is a change in the reproduction speed from that point of time and therefore, in this case, the reproduction speed of the voice waveform 903 presently under reproduction becomes still higher).

Accordingly, even when a demand for the reproduction of a plurality of voices has come, it never happens that the overlap of the reproduction of the voices occurs and it becomes difficult to hear the voices, and it becomes possible to hear the voices reproduced in a state in which the waiting time till voice reproduction is short to the utmost. At the step S2605, it is also possible to up the reproduction speed at finer steps in conformity with the number of voice waveforms waiting for reproduction.

As described above, there is achieved the effect that it never happens that when a plurality of voice outputs have been sent, the voices reproduced overlap each other and become difficult to hear, and it becomes possible to hear the reproduced voices in a state in which the time for waiting for the turn of reproduction is short to the utmost.

If the present embodiment is used, for example, in a system wherein text information sent from various places in a recreation ground is voice broadcasting through a server computer, there will be achieved the effect that even when the bits of information sent overlap each other temporarily, it never happens that they are reproduced in superimposed relationship with each other and become difficult to hear, and it becomes possible to hear reproduced voices in a state in which the time for waiting for the turn of reproduction is short to the utmost.

Also, if the present embodiment is used, for example, in a chat system wherein a plurality of users connected by Internet make conversation by text data through a server computer, there will be achieved the effect that it never happens that when text data which is other user's utterance sent from the server computer is to be voice-outputted, when the voice outputs of the text data from the plurality of users become likely to overlap each other, the voices are reproduced in overlapping relationship with each other and become difficult to hear, and it becomes possible to hear the reproduced voices in a state in which the time for waiting for the turn of reproduction is short to the utmost.

Seventh Embodiment

A seventh embodiment of the present invention is a system for voice-outputting text data non-synchronously sent from other computer (server computer), wherein before the voice outputting of a text datum is terminated, when the next text data is sent, a predetermined blank period is provided after the utterance of a voice earlier under voice output has been terminated and before the utterance of the next synthetic voice is begun. Also, in the aforedescribed embodiment, when during the voice outputting of a text datum, the next synthetic voice waveform is detected, the reproduction speed of each voice has been upped, but in the present embodiment, it is to be understood that the reproduction speeds of the two are not particularly upped, but each voice is outputted at an ordinary reproduction speed.

The voice synthesizing apparatus according to the seventh embodiment of the present invention, like the above-described first embodiment, is provided with a CPU 101, a hard disc controller (HDC) 102, a hard disc (HD) 103 having a program 113, a dictionary 114 and phoneme data 115, a keyboard 104, appointing device (PD) 105, a RAM 106, a communication line interface (I/F) 107, VRAM 108, a display controller 109, a monitor 110, a sound card 111 and a speaker 112 (see FIG. 1). The CPU 101 executes the processing shown in the flow charts of FIGS. 5 and 6 which will be described later. The construction of each portion of the voice synthesizing apparatus has been described in detail in the first embodiment and therefore need not be described.

Also, the program module of the voice synthesizing apparatus according to the seventh embodiment of the present invention, like that of the above-described first embodiment, is provided with the dictionary 114, the phoneme data 115, a main routine initializing portion 201, a voice processing initializing portion 202, a communication data processing portion 204, a communication data storing portion 206, a display text data storing portion 207, a text display portion 208, a voice waveform generating portion 209, a voice output portion 210, a communication processing portion 211 having an initializing portion 203 and a receiving portion 205, an acoustic parameter 212 and an output parameter 213 (see FIG. 2). The construction of the program module of the voice synthesizing apparatus has been described in detail in the first embodiment and therefore need not be described.

Also, the voice output portion 210 of the voice synthesizing apparatus according to the seventh embodiment of the present invention, like that in the above-described sixth embodiment, is provided with a temporary accumulation portion 901, a control portion 902 and a voice reproduction portions 904 (see FIG. 9). Design is made such that when voice reproduction is being executed by the voice reproduction portions 904, the termination of the reproduction is waited for. The construction of each portion of the voice output portion 210 has been described in detail in the sixth embodiment and therefore need not be described.

The operation of the voice synthesizing apparatus according to the seventh embodiment of the present invention constructed as described above will now be described in detail with reference to FIGS. 27 and 28. The following processing is executed under the control of the CPU 101 shown in FIG. 1.

Figure 27:
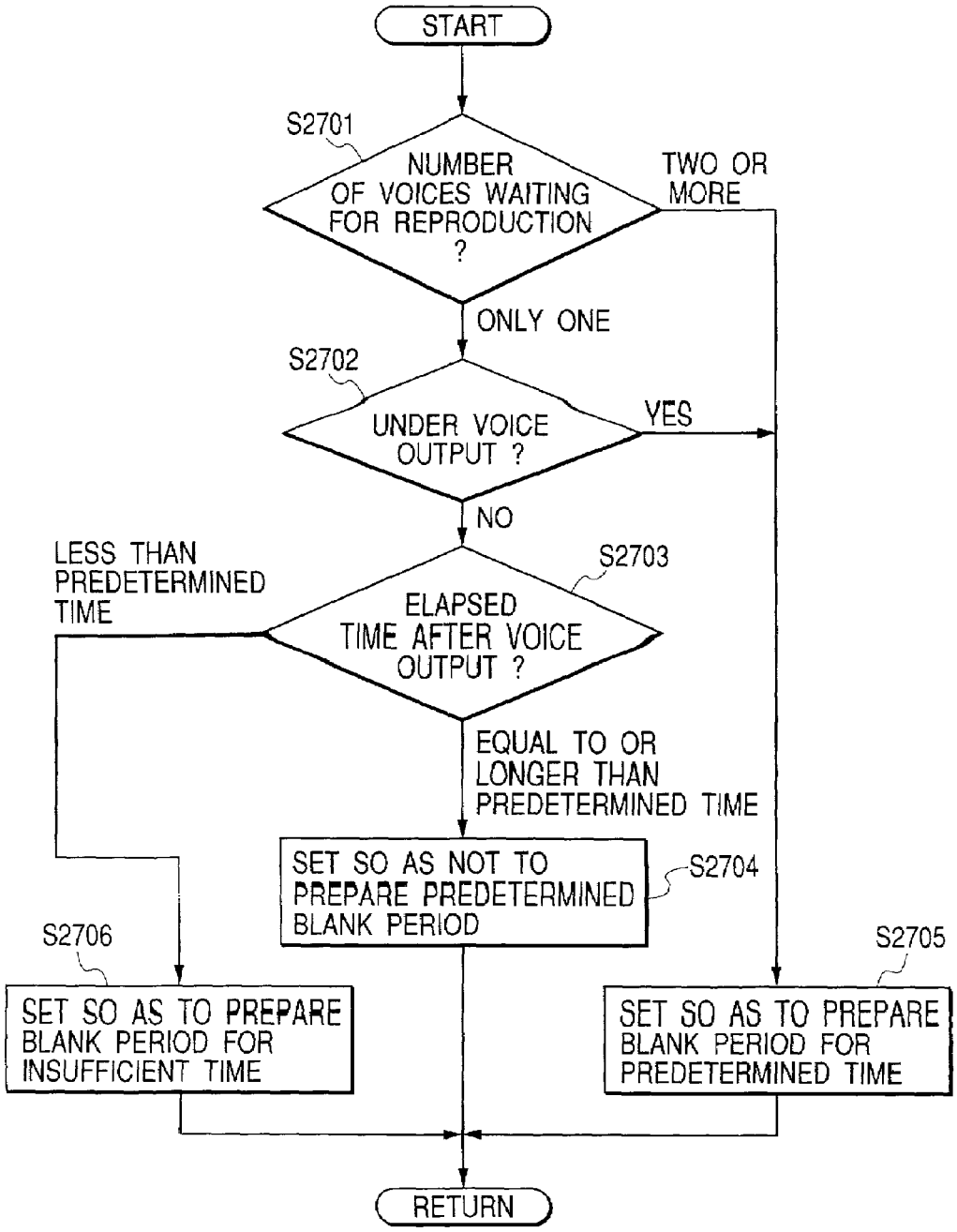
FIG. 27 is a flow chart showing the process of checking up the connection of voices executed when a voice waveform is sent from the voice waveform generating portion of the voice synthesizing apparatus according to the embodiment (7) of the present invention to a voice output portion.

FIG. 27 is a flow chart regarding the check-up of the connection during reproduction executed when a voice waveform has been sent from the voice waveform generating portion 209 of the voice synthesizing apparatus to the voice output portion 210. When a voice waveform has been sent to the voice output portion 210, first at a step S2701, the control portion 902 of the voice output portion 210 examines how many voice waveforms waiting for reproduction exist in the temporary accumulation portion 901. If as the result, there is only one voice waveform waiting for reproduction (i.e., only the voice waveform which has just been sent), advance is made to a step S502. On the other hand, if there are two or more voice waveforms waiting for reproduction (that is, there are one or more voice waveforms waiting for reproduction besides the voice waveform which has just been sent), advance is made to a step S2705.

Next, at a step S2702, the control portion 902 examines the operative state of the voice reproduction portions 904 and confirms whether they are outputting voices. If as the result, they are not outputting voices, advance is made to a step S2703, and if they are outputting voices, advance is made to a step S2705. Next, at the step S2703, the control portion 902 checks up how much time has elapsed after the termination of the final voice output. If the time is shorter than a predetermined time, advance is made to a step S2706, and if the time is equal to or longer than the predetermined time, advance is made to a step S2704.

The step S2704 is a step executed when there is no voice waiting for reproduction except the voice waveform which has just arrived and there is no voice presently under reproduction and further, a predetermined time or longer has elapsed after the voice reproduced lastly was terminated, and here, the setting of a flag that the blank of a predetermined time is not provided is effected, thus terminating the processing of this flow.

The step S2705 is a step executed when there is a voice waiting for reproduction besides the voice waveform which has just arrived and there is a voice presently under reproduction, and here, the setting of a flag that the blank of a predetermined time is provided is effected, thus terminating the processing of this flow. In this case, the above-mentioned predetermined time can be set arbitrarily.

The step S2706 is a step executed when a predetermined time has not elapsed after the voice reproduced lastly was terminated, and here, the setting of a flag that the blank of an insufficient time till a predetermined time is provided and the setting of the insufficient time are effected, thus terminating the processing of this flow. The insufficient time T can be found by $$T = t0 - t1,$$

where t1 is the predetermined time, and t1 is the lapse time from after the voice reproduced lastly was terminated.

Figure 28:
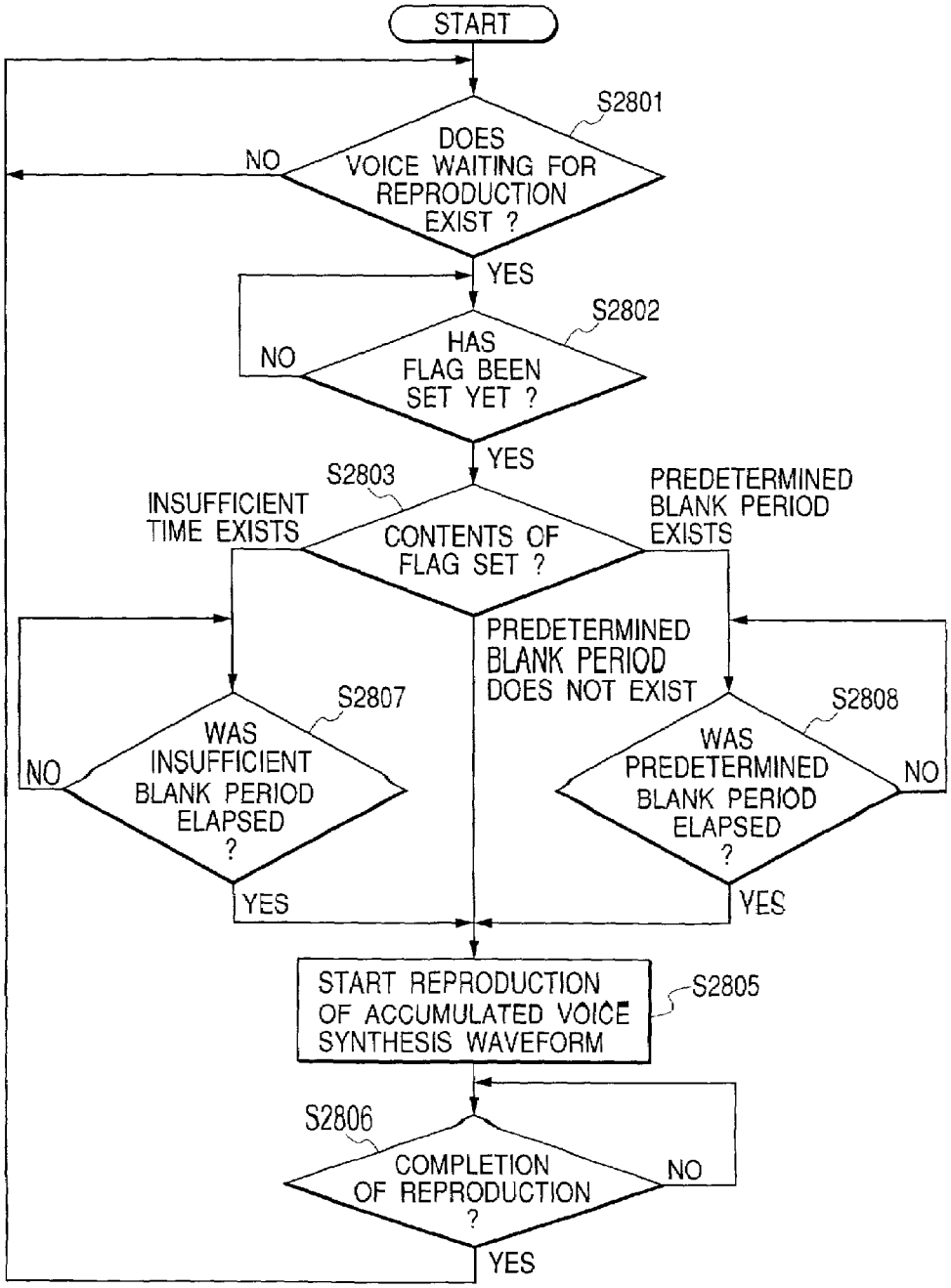
FIG. 28 is a flow chart showing the process of executing the actual voice waveform reproduction by the voice output portion of the voice synthesizing apparatus according to the embodiment (7) of the present invention.

FIG. 28 is a flow chart of the process of executing actual voice waveform reproduction. First, at a step S2801, the control portion 902 of the voice output portion 210 examines whether a voice waveform waiting for reproduction exists in the temporary accumulation portion 901. If no voice waveform waiting for reproduction exists in the temporary accumulation portion 901, the step S2801 is repeated and the arrival of a voice waveform is waited for. At a step S2802, the control portion 902 confirms whether the setting of a flag indicating the presence or absence of the blank of the predetermined time shown in the flow chart of FIG. 27 has been finished when a voice waveform waiting for reproduction exists in the temporary accumulation portion 901. If the setting of the flag has not yet been finished, the step S2802 is repeated and the setting of the flag is waited for.

Next, at a step S2803, the control portion 902 confirms what flag has been set. If the flag is set to "a predetermined blank period exists", advance is made to a step S2804, where the control portion 902 waits for for a predetermined time to elapse, and advance is made to a step S2805. At this step S2805, the control portion 902 waits for for the predetermined time to elapse, whereby the voice reproduction during this time is not effected and therefore, a predetermined blank period i.e., a voiceless period, is born.

If at the step S2803, the flag is set to "an insufficient time exists", advance is made to a step S2807, where the control portion 902 waits for for the insufficient time to elapse, and advance is made to a step S2805. At this step S2805, the control portion 902 waits for for the insufficient time to elapse, whereby the voice reproduction during this time is not effected and therefore, the time from after the voice reproduced lastly has been terminated is added, and a predetermined blank period, i.e., a voiceless period, is born.

The step S2805 is a step executed when at the step S2803, the flag is set to "a predetermined blank period does not exist" and after at the step S2804 or the step S2807, the lapse of a predetermined time or the insufficient time is waited for, and the first voice waveform 903 accumulated in the temporary accumulation portion 901 starts to be reproduced by the voice reproduction portion 904. Thereafter, at a step S2806, the termination of the reproduction of this voice waveform is waited for, and return is made to the step S2801.

By doing so, when demands for the reproduction of a plurality of voices are sent in overlapping relationship with each other and the voices are intactly reproduced, the voices are connected and the punctuation of the voice information becomes difficult to know, whereas a predetermined blank which can be apparently known as punctuation is put into the voice information, whereby hearers become able to easily distinguish the punctuation of the information.

As described above, according to the voice synthesizing apparatus according to the seventh embodiment of the present invention, there is achieved the effect that when a plurality of voice outputs have been sent, a predetermined blank which can be apparently known as punctuation is inserted therebetween, whereby it never happens that the reproduced voices are connected, but the punctuation of the voice information can be known distinctly and therefore the voice information can be heard out easily.

If the present embodiment is used, for example, in a system for voice-broadcasting text information sent from various places in a recreation ground, through a server computer, there is achieved the effect that even when bits of information are sent in temporarily overlapping relationship with each other with a result that voices become likely to be connected and reproduced, the punctuation of the voice information can be known distinctly and therefore the voice information can be heard out easily.

Also, if the present embodiment is used, for example, in a chat system wherein a plurality of users connected by Internet make conversation by text data through a server computer, there will be achieved the effect that when text data which is other user's utterance sent from the server computer is to be voice-outputted, even when text data from the plurality of users are sent in temporarily overlapping relationship with each other with a result that the voices become likely to be connected and reproduced, the punctuation of the voice information can be known distinctly and therefore the voice information can be heard out easily.

Eighth Embodiment

An eighth embodiment of the present invention is a system for voice-outputting text data non-synchronously sent from other computer (server computer), wherein before the voice outputting of a text datum is terminated, when the next text data is sent, the utterance of a prepared specific synthetic voice such as "Attention please. We give you the next information." is effected after the utterance of a voice earlier under voice output has been terminated and before the utterance of the next synthetic voice is started.

Figure 29:
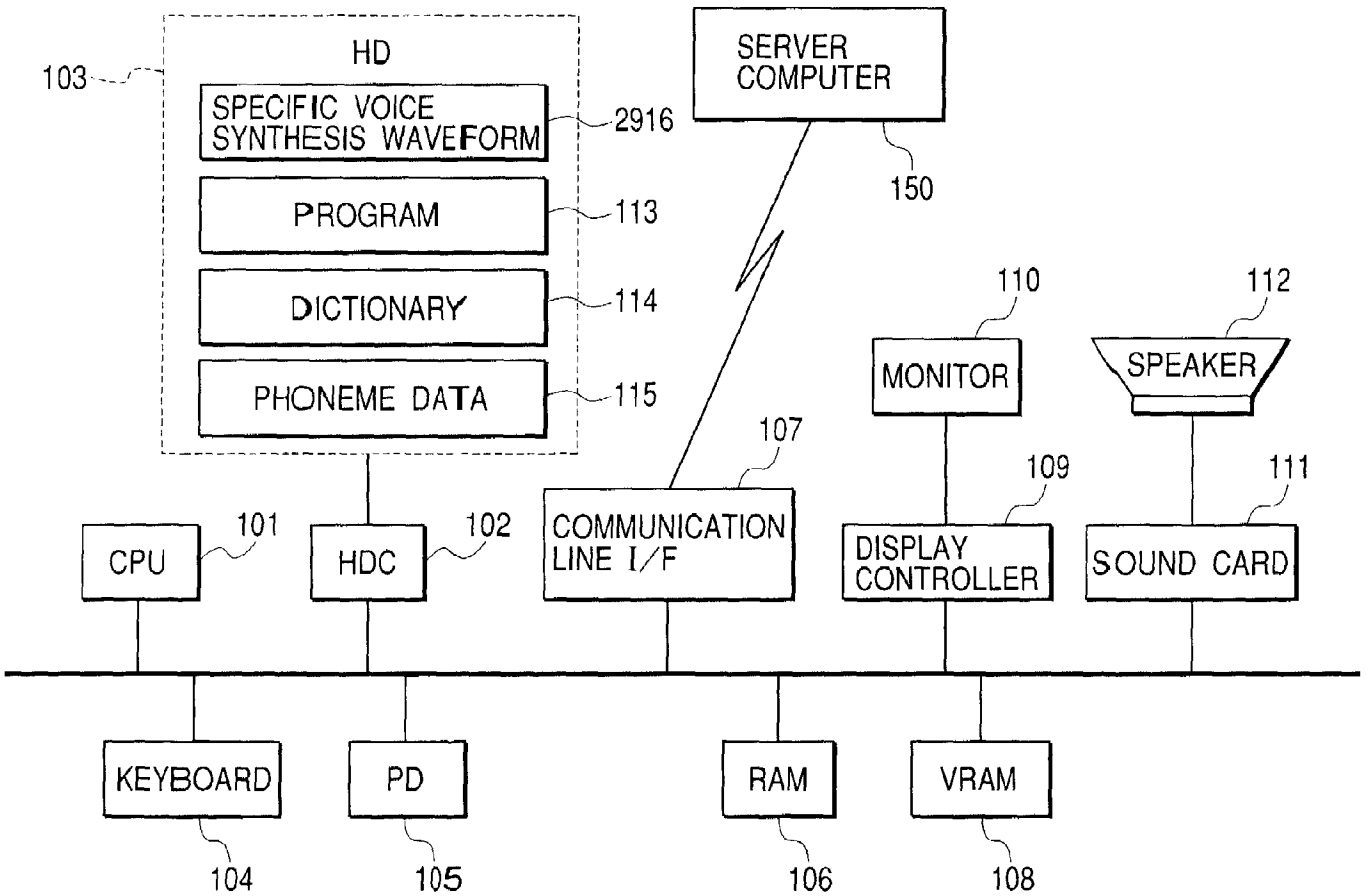
FIG. 29 is a block diagram showing an example of the general construction of the voice synthesizing apparatus according to the embodiment (8) of the present invention.

FIG. 29 is a block diagram showing an example of the construction of a voice synthesizing apparatus according to the eighth embodiment of the present invention. The voice synthesizing apparatus according to the eighth embodiment of the present invention is provided with a CPU 101, a hard disc controller (HDC) 102, a hard disc (HD) 103 having a program 113, a dictionary 114, phoneme data 115 and a specific voice synthesis waveform 116, a keyboard 104, a pointing device (PD) 105, a RAM 106, a communication line interface (I/F) 107, VRAM 108, a display controller 109, a monitor 110, a sound card 111 and a speaker 112. In FIG. 29, the reference numeral 150 designates a server computer.

Figure 31:
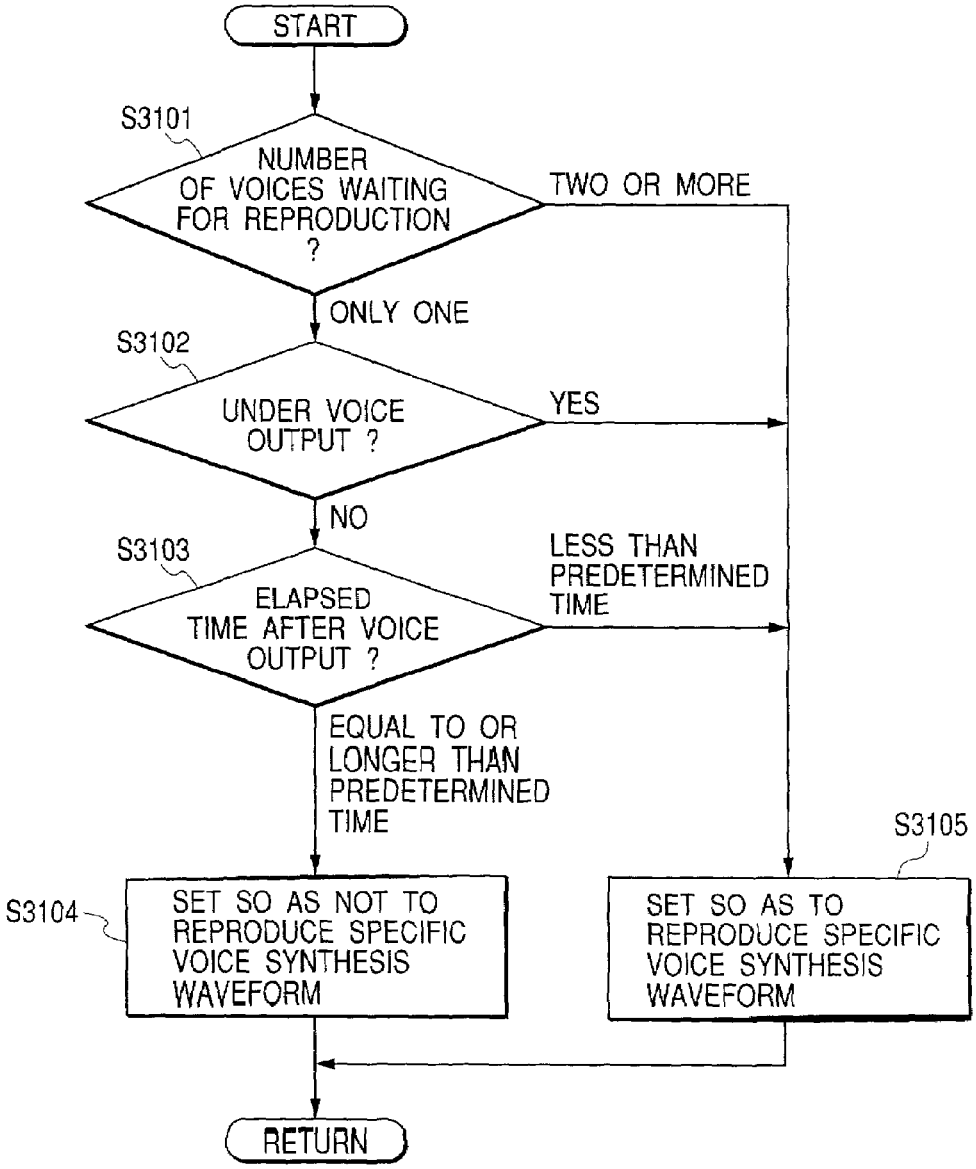
FIG. 31 is a flow chart showing the process of checking up the connection of voices executed when a voice waveform is sent from the voice waveform generating portion of the voice synthesizing apparatus according to the embodiment (8) of the present invention to a voice output portion.
Figure 32:
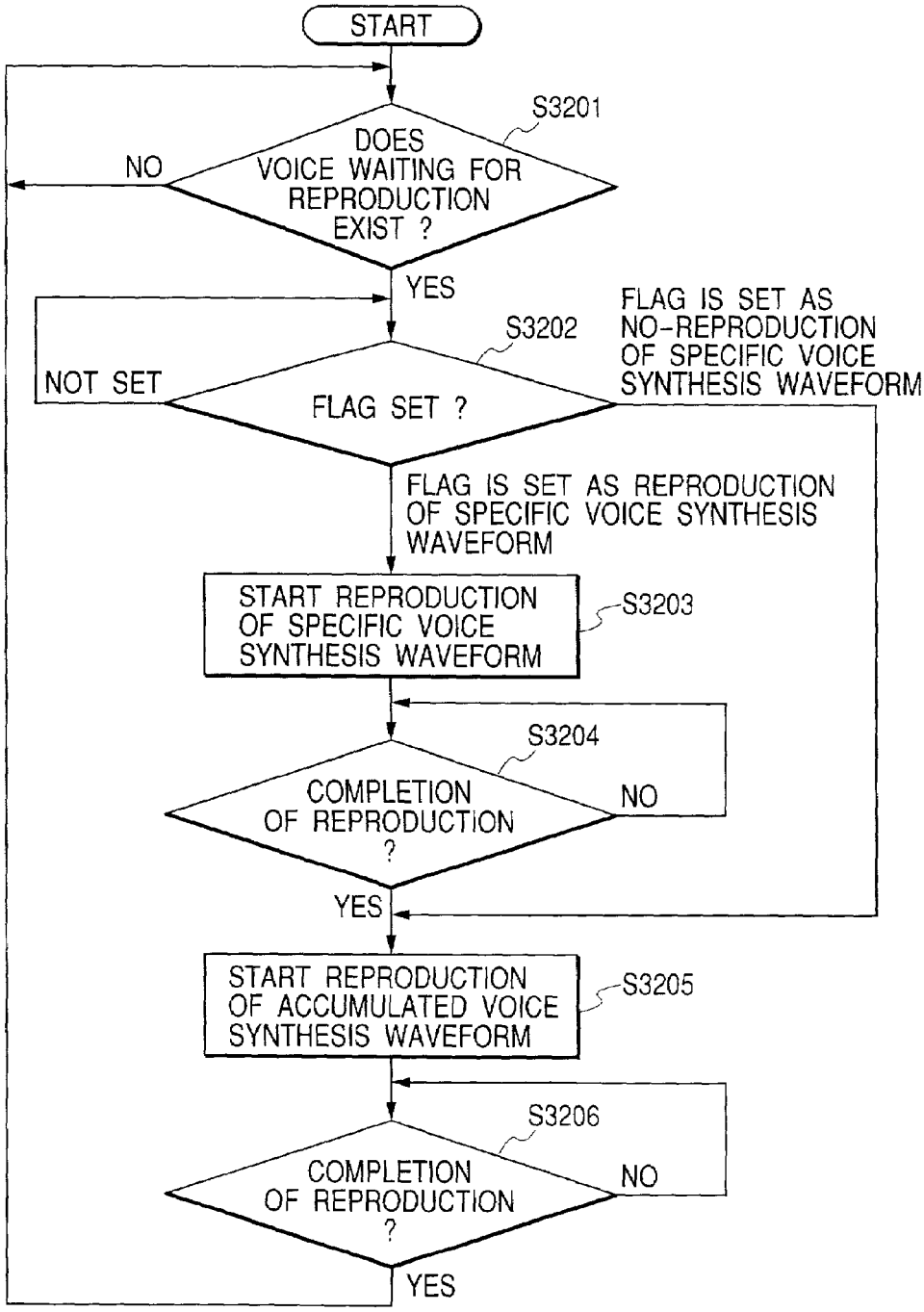
FIG. 32 is a flow chart showing the process of executing the actual voice waveform reproduction by the voice output portion of the voice synthesizing apparatus according to the embodiment (8) of the present invention.

Describing the differences of the eighth embodiment from the above-described embodiment, the CPU 101 executes the processing shown in the flow charts of FIGS. 31 and 32. The specific voice synthesis waveform 116 stored in the hard disc 103 is a specific voice synthesis waveform such as "Attention please. We give you the next information." used when two voice syntheses are likely to be connected. The construction of each portion of the voice synthesizing apparatus has been described in detail in the first embodiment and therefore need not be described.

Figure 30:
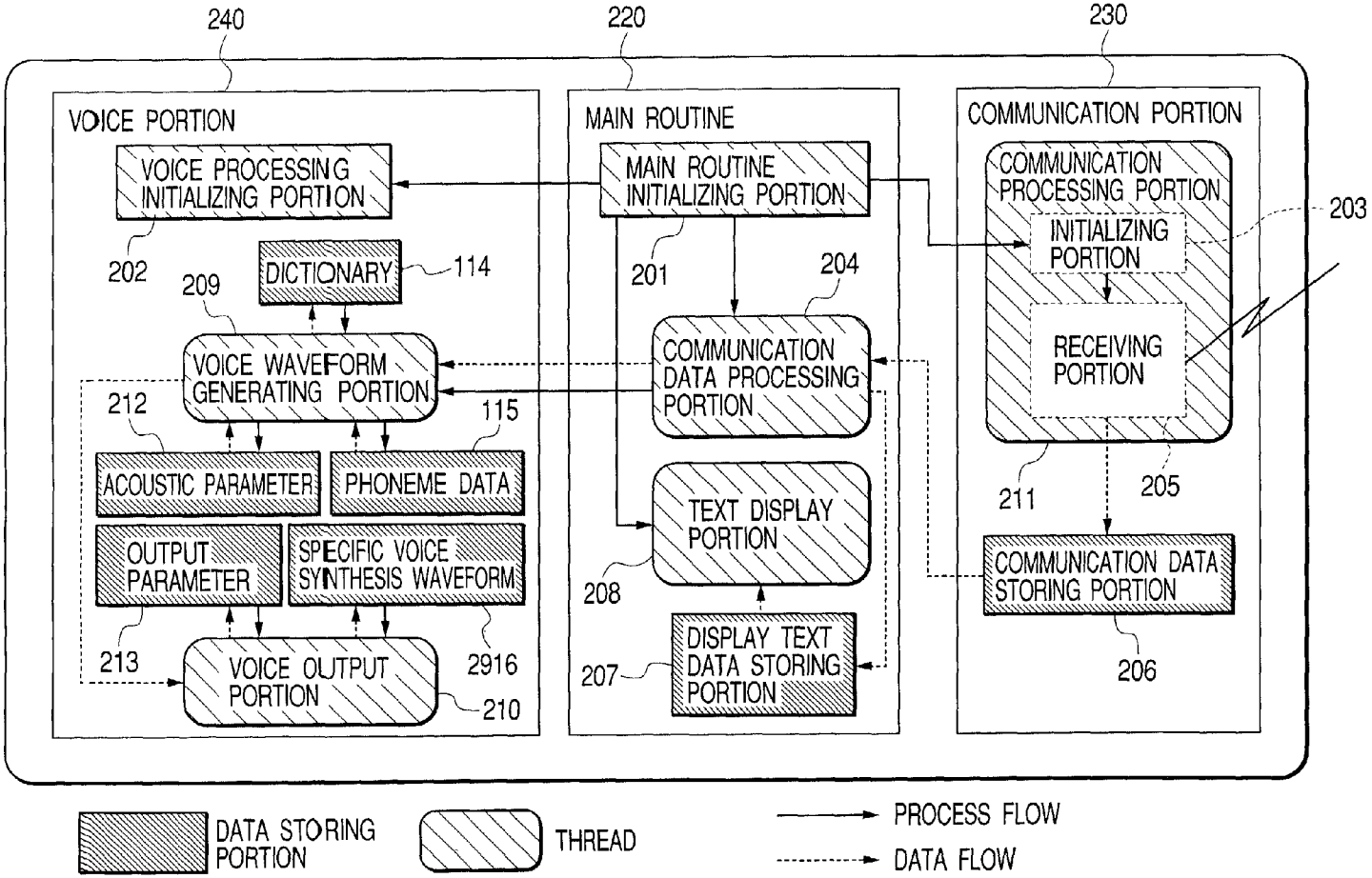
FIG. 30 is an illustration showing an example of the construction of the module of the program of the voice synthesizing apparatus according to the embodiment (8) of the present invention.

FIG. 30 is an illustration showing the module relation of the program of the voice synthesizing apparatus according to the eighth embodiment of the present invention. The voice synthesizing apparatus according to the eighth embodiment of the present invention is provided with the dictionary 114, the phoneme data 115, a main routine initializing portion 201, a voice processing initializing portion 202, a communication data processing portion 204, a communication data storing portion 206, a display text data storing portion 207, a text display portion 208, a voice waveform generating portion 209, a voice output portion 210, a communication processing portion 211 having an initializing portion 203 and a receiving portion 205, an acoustic parameter 212, an output parameter 213 and the specific voice synthesis waveform 116. The construction of each of the other portions of the program module than the specific voice synthesis waveform 116 of the voice synthesizing apparatus has been described in detail in the first embodiment and therefore need not be described.

Also, the voice output portion 210 of the voice synthesizing apparatus according to the eighth embodiment of the present invention, like that in the above-described sixth embodiment, is provided with a temporary accumulation portion 901, a control portion 902 and voice production portions 904 (see FIG. 9). The voice production portions 904 are designed to be capable of also reproducing the specific voice synthesis waveform 116 shown in FIG. 30, in accordance with the instructions from the control portion 902. The construction of each portion of the voice output portion 210 has been described in detail in the first embodiment and therefore need not be described.

The operation of the voice synthesizing apparatus according to the eighth embodiment of the present invention constructed as described above will now be described with reference to FIGS. 31 and 32. The following processing is executed under the control of the CPU 101 shown in FIG. 1.

FIG. 31 is a flow chart regarding the check-up of the connection during reproduction executed when a voice waveform has been sent from the voice waveform generating portion 209 of the voice synthesizing apparatus to the voice output portion 210. When the voice waveform has been sent to the voice output portion 210, first at a step S3101, the control portion 902 of the voice output portion 210 examines how many voice waveforms waiting for reproduction exist in the temporary accumulation portion 901. If as the result, there is only one voice waveform waiting for reproduction (i.e., only the voice waveform which has just been sent), advance is made to a step S3102. On the other hand, if there are two or more voice waveforms waiting for reproduction (that is, there are one or more voice waveforms waiting for reproduction besides the voice waveform which has just been sent), advance is made to a step S3105.

Next, at the step S3102, the control portion 902 examines the operative state of the voice reproduction portions 904, and confirms whether they are outputting voices. If as the result, they are not outputting voices, advance is made to a step S3103, and if they are outputting voices, advance is made to a step S3105. Next, at the step S3103, how much time has elapsed after the termination of the final voice output is checked up. If the time is shorter than a predetermined time, advance is made to the step S3105, and if the time is equal to or longer than the predetermined time, advance is made to a step S3104.

The step S3104 is a step executed when there is no voice waiting for reproduction except the voice waveform which has just arrived and there is no voice presently under reproduction and further, a predetermined time or longer has elapsed after the lastly reproduced voice was terminated, and here, the setting of a flag that the reproduction of the specific voice synthesis waveform is not effected is done, thus terminating the processing of this flow. The step S3105 is a step executed when there is a voice waiting for reproduction except the voice waveform which has just arrived or there is a voice presently under reproduction or a predetermined time or longer has not elapsed after the lastly reproduced voice was terminated, and here, the setting of a flag that the reproduction of the specific voice synthesis waveform is effected is done, thus terminating the processing of this flow.

FIG. 32 is a flow chart of the process of executing actual voice waveform reproduction.

First, at a step S3201, the control portion 902 of the voice output portion 210 examines whether a voice waveform waiting for reproduction exists in the temporary accumulation portion 901. If no voice waveform waiting for reproduction exists in the temporary accumulation portion 901, the step S3201 is repeated and the arrival of a voice waveform is waited for. At a step S3202, if a voice waveform waiting for reproduction exists in the temporary accumulation portion 901, the setting of a flag indicative of the presence or absence of the specific voice synthesis waveform shown in the flow chart of FIG. 31 is confirmed. If the setting of the flag has not yet been terminated, the step S3202 is repeated and the setting of the flag is waited for.

If the flag is set to "reproduction", advance is made to the step S3203, where the control portion reads out the specific voice synthesis waveform indicated at 116 in FIG. 30, and starts reproduction by the voice reproduction portion 904. At a step S3204, the termination of the reproduction of the specific voice synthesis waveform started at the step S3203 is waited for, and advance is made to a step S3205.

The step S3205 is a step executed when at the step S3202, the flag is set to "no reproduction" and after at the step S3203 and the step S3204, the reproduction of the specific voice synthesis waveform is terminated, and this voice waveform starts to be reproduced by the voice reproduction portion 904. Thereafter, at a step S3206, the termination of the reproduction of this voice waveform is waited for, and return is made to the step S3201.

By doing so, when demands for the reproduction of a plurality of voices are sent in overlapping relationship with each other and the voices are intactly reproduced, the voices are connected and the punctuation of the voice information becomes difficult to know, whereas the reproduction of the specific voice synthesis waveform such as "Attention please. We give you the next information." which can be apparently known as punctuation is put into the voice information, whereby hearers become able to distinguish the punctuation of the information easily.

As described above, according to the voice synthesizing apparatus according to the eighth embodiment of the present invention, there is achieved the effect that when a plurality of voice outputs have been sent, even if the voices reproduced are connected and become difficult to hear, the punctuation of voice information can be known distinctly owing to the insertion of the specific voice synthesis waveform which can be apparently known as punctuation and therefore, the voice information can be heard out easily.

If the present embodiment is used, for example, in a system for voice-broadcasting text information sent from various places in a recreation ground, through a server computer, there is achieved the effect that even when bite of information are sent in temporarily overlapping relationship with each other with a result that voices are connected and reproduced, the punctuation of the voice information can be known distinctly and therefore, the voice information can be heard out easily.

Also, if the present embodiment is used, for example, in a chat system wherein a plurality of users connected by Internet make conversation by text data through a server computer, there will be achieved the effect that when text data which is other user's utterance sent from the server computer is to be voice-outputted, even when text data from the plurality of users are sent in temporarily overlapping relationship with each other with a result that voices are connected and reproduced, the punctuation of the voice information can be known distinctly and therefore, the voice information can be heard out easily.

While in the above-described embodiments of the present invention, a case where text data is voice-broadcast in a recreation ground has been mentioned as a specific example to which the voice synthesizing apparatus is applied, the present invention is also applicable to various fields such as voice broadcasting regarding the entertainment guides/reference calls, etc. in various entertainment facilities such as motor shows, voice broadcasting regarding the race guide/reference calls, etc. in various sports facilities such as can race facilities, etc., and effects similar to those of the above-described embodiments are obtained.

As described above, there is achieved the effect that when the overlapping of the reproduction timing of the synthetic voices of a plurality of text data is detected, it never happens that the speed of voice reproduction is upped in conformity with the presence or absence of a voice waveform presently under reproduction or the number of voice waveforms waiting for reproduction, whereby a plurality of text data are uttered at a time and become difficult to hear, and it becomes possible to hear voices reproduced in a state in which the waiting time till voice reproduction is short to the utmost.

Also, there is achieved the effect that when the connection of the reproduction timing of the synthetic voices of a plurality of text data is detected, a predetermined blank period for making punctuation clear is provided after a voice waveform presently under reproduction, whereby it never happens that the plurality of text data are connected, and the punctuation of the voice information can be known distinctly and therefore, it becomes possible to hear out the voice information easily.

Also, there is achieved the effect that when the connection of the reproduction timing of the synthetic voices of a plurality of text data is detected, the reproduction of a specific voice synthesis waveform informing of discrete information after is effected after a voice waveform presently under reproduction, whereby even when the plurality of data are connected and uttered, the punctuation of the voice information can be known distinctly and therefore, it become possible to hear out the voice information easily.

Also, there is achieved the effect that as described above, it never happens that a plurality of text data are uttered at a time and become difficult to hear, and it becomes possible to hear voices reproduced in a state in which the waiting time till voice reproduction is short to the utmost.

Figure 7:
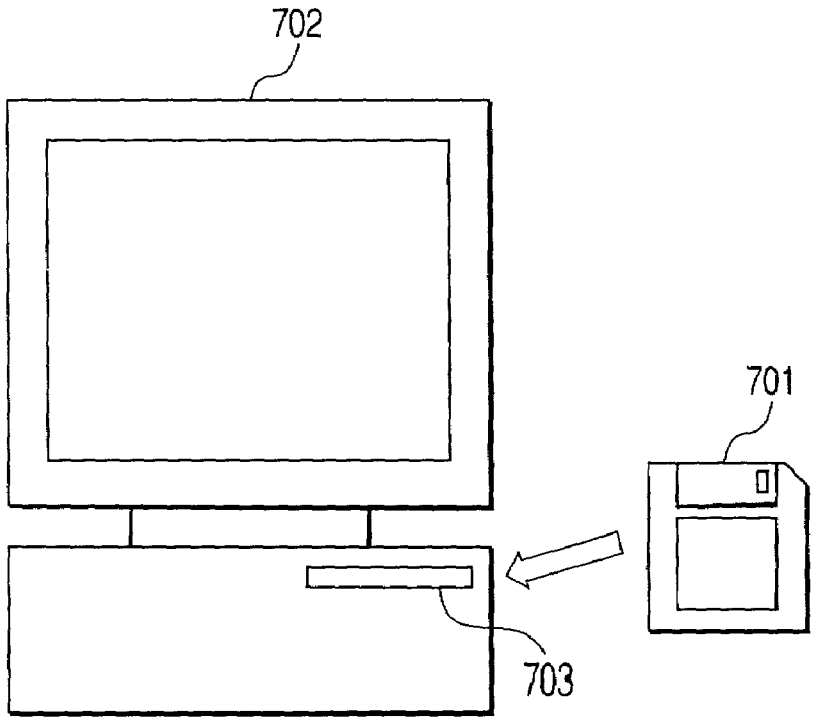
FIG. 7 is an illustration showing an example of the concept in which the program according to the embodiment of the present invention and the related data are supplied from the storage medium to the apparatus.

FIG. 7 is an illustration showing a conceptual example in which a program according to an embodiment of the present invention and related data are supplied from a storage medium to the apparatus. The program and the related data are supplied by a storage medium 701 such as a floppy disc or a CD-ROM being inserted into a storage medium drive insertion port 703 provided in the apparatus 702. Thereafter, the program and the related data are once installed from the storage medium 701 into a hard disc and loaded from the hard disc into a RAM, or the not installed into the hard disc but are directly loaded into the RAM, whereby it becomes possible to execute the program and the related data.

In this case, when the program is to be executed in the voice synthesizing apparatus according to the embodiment of the present invention, the program and the related data are supplied to the voice synthesizing apparatus by such a procedure as shown in FIG. 7 or the program and the related data are store in advance in the voice synthesizing apparatus, whereby the execution of the program becomes possible.

Figure 6:
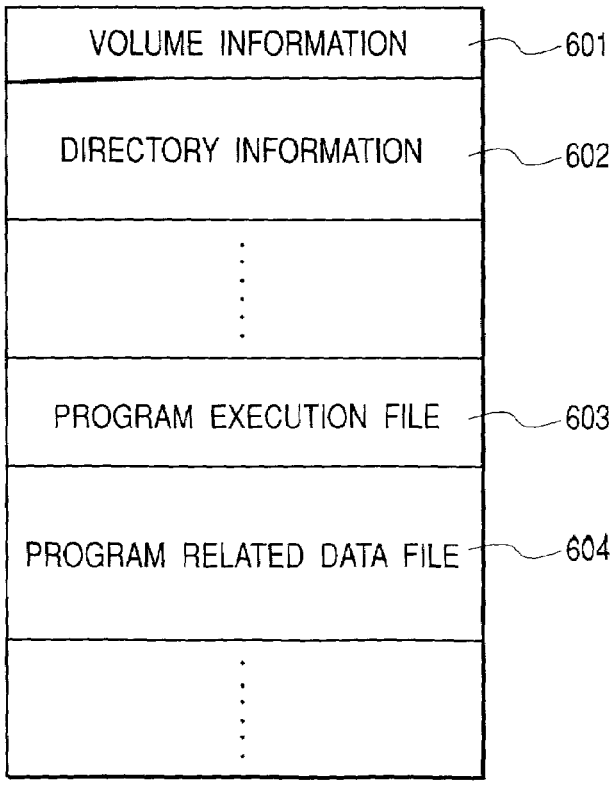
FIG. 6 is an illustration showing an example of the construction of the stored contents in a storage medium storing therein a program according to the embodiment of the present invention and related data.

FIG. 6 is an illustration showing an example of the construction of the stored contents of a storage medium storing therein the program according to the embodiment of the present invention and the related data. The storage medium is comprised of stored contents such as volume information 601, directory information 602, a program execution file 603 (corresponding to the program 113 of FIG. 1) and a program related data file 604 (corresponding to the dictionary 114, the phoneme data 115, etc. of FIG. 1). The program is program-coded on the basis of the flow chart of FIG. 4 which will be described later.

The present invention may be applied to a system comprised of a plurality of instruments or to an apparatus comprising an instrument. If course, the present invention is also achieved by the supplying a system or an apparatus with a storage medium storing therein the program code of software realizing the functions of the above-described embodiments, and the computer (or the CPU or the MPU) of the system or the apparatus reading out and executing the program stored in a medium such as the storage medium.

In this case, the program code itself read out from the medium such as the storage medium realizes the functions of the above-described embodiments, and the medium such as the storage medium storing the program code therein constitute the present invention. As the medium such as the storage medium for supplying the program code, use can be made of a method such as down load, for example, through a floppy disc, a hard disc, an optical disc, a magneto-optical disc, a CD-ROM, a CD-R, a magnetic tape, a non-volatile memory card, a ROM or a network.

Also, of course, the present invention covers a case where a program code read out by a computer is executed, whereby not only the functions of the above-described embodiments are realized, but on the basis of the instructions of the program code, OS or the like working on the computer executes part or the whole of actual processing and the functions of the above-described embodiments are realize by the processing.

Further, of course, the present invention also covers a case where a program code read out from a medium such as a storage medium is written into a memory provided in a function expansion board inserted in a computer or a function expansion unit connected to a computer, whereafter on the basis of the instructions of the program code, a CPU or the like provided in the function expansion board or the function expansion unit executes part or the whole of actual processing and the functions of the above-described embodiments are realized by the processing.

What is claimed is:

1. A speech synthesizing apparatus for converting a plurality of text data into synthetic speech and outputting it, comprising:

speech waveform generating means for generating synthetic speech waveforms of said plurality of text data;

overlap detecting means for detecting the overlap of the synthetic speech waveforms of the plurality of said text data;

display control means for controlling the displaying of a setting screen configured to set the importance of said plurality of text data in response to the output of said overlap detecting means;

volume determining means for determining the volumes of the synthetic speech waveforms of each of said plurality of text data on the basis of the importance of said plurality of text data set by the setting screen; and speech output means for speech-synthesizing and outputting synthetic speech waveforms generated from said plurality of text data whose overlap has been detected at the volume determined by said volume determining means, wherein when two synthetic speech waveforms overlap each other, said speech output means makes the volume of one synthetic speech waveform a/(a+b) and makes the volume of the other synthetic speech waveform b/(a+b), where a is a value of a parameter of the importance of the one synthetic speech waveform, and b is a value of a parameter of the importance of the other synthetic speech waveform.

2. A speech synthesizing apparatus according to claim 1, further comprising receiving means for receiving said plurality of text data and data on the importance of the plurality of text data from the outside of said apparatus.

3. A speech synthesizing method applied to a speech synthesizing apparatus for converting a plurality of text data into synthetic speech and outputting it, said method comprising:

a receiving step of receiving the plurality of text data;

a speech waveform generating step of generating synthetic speech waveforms from the received plurality of text data;

an overlap detecting step of detecting the overlap of the synthetic speech waveforms of the plurality of the text data;

a display control step of controlling displaying a setting screen configured to set the importance of the plurality of text data in response to the output of said overlap detecting step;

a volume determining step of determining the volumes of the synthetic speech waveforms of each of the plurality of text data on the basis of the importance of the plurality text data set in the setting screen; and a speech outputting step of speech-synthesizing and outputting the synthetic speech waveforms generated from the plurality of the text data whose the overlap has been detected at the volume determined by said volume determining step, wherein when two synthetic speech waveforms overlap each other, said speech outputting step makes the volume of one synthetic speech waveform a/(a+b) and makes the volume of the other synthetic speech waveform b/(a+b), where a is a value of a parameter of the importance of the one speech waveform, and b is a value of a parameter of the importance of the other speech waveform.

4. A speech synthesizing method according to claim 3, further comprising the step of receiving data on the importance of the plurality of text data from the outside of the apparatus.

5. A storage medium storing therein a control program for making a computer perform the speech synthesizing method according to claim 3.

6. A control program for making a computer perform the speech synthesizing method according to claim 3.

7. A speech synthesizing apparatus for converting a plurality of text data into synthetic speech and outputting it, said apparatus comprising:

a speech synthesizer configured to generate synthetic speech waveforms of the plurality of text data in accordance with the importance of the plurality of text data and outputting the synthetic speech waveforms at one time comprising:

display control means for controlling the displaying of a setting screen configured to set the importance of the plurality of text data;

volume determining means for determining the volumes of the synthetic speech waveforms of each of said plurality of text data on the basis of the importance of the plurality of text data set by the setting screen; and speech output means for speech-synthesizing and outputting synthetic speech waveforms generated from said plurality of text data at the volume determined by said volume determining means, wherein when two synthetic speech waveforms overlap each other, said speech output means makes the volume of one synthetic speech waveform a/(a+b) and makes the volume of the other synthetic speech waveform b/(a+b), where a is a value of a parameter of the importance of the one synthetic speech waveform, and b is a value of a parameter of the importance of the other synthetic speech waveform.

8. A speech synthesizing apparatus according to claim 7, further comprising receiving means for receiving the plurality of text data and importance data indicative of the importance of the plurality of text data from the outside of the apparatus.

9. A speech synthesizing apparatus for converting a plurality of text data into synthetic speech and outputting it, said apparatus comprising:

a speech waveform generator configured to generate synthetic speech waveforms of the plurality of text data;

a display controller configured to control the displaying of a setting screen configured to set the importance of said plurality of text data;

a volume determining device configured to determine the volumes of the synthetic speech waveforms of each of said plurality of the text data on the basis of the importance of said plurality of text data set by the setting screen; and a speech output device configured to perform speech-synthesizing synthesizing the synthetic speech waveforms generated from the plurality of text data at different volumes determined by said volume determining device and outputting the synthetic speech waveforms at one time, wherein when two synthetic speech waveforms overlap each other, said speech output device makes the volume of one synthetic speech waveform a/(a+b) and makes the volume of the other synthetic speech waveform b/(a+b), where a is a value of a parameter of the importance of the one synthetic speech waveform, and b is a value of a parameter of the importance of the other synthetic speech waveform.

10. A speech synthesizing apparatus according to claim 9, further comprising receiving means for receiving the plurality of text data and data indicative of the importance of the plurality of text data from the outside of the apparatus.

11. A speech synthesizing method applied to a speech synthesizing apparatus for converting a plurality of text data into synthetic speech and outputting it, said method comprising:

a speech outputting step of generating synthetic speech waveforms of the plurality of text data in accordance with the importance of the plurality of text data and outputting the synthetic speech waveforms at one time, comprising:

a speech waveform generating step of generating synthetic speech waveforms from the plurality of the text data;

a display control step of controlling the displaying of a setting screen configured to set the importance of the plurality of text data;

a volume determining step of determining the volumes of the synthetic speech waveforms of each of the plurality of text data on the basis of the importance of the plurality text data set by the setting screen; and a speech outputting step of speech-synthesizing and outputting the synthetic speech waveforms generated from the plurality of the text data at the volume determined by said volume determining step at one time, wherein when two synthetic speech waveforms overlap each other, said speech outputting step of speech-synthesizing and outputting makes the volume of one synthetic speech waveform a/(a+b) and makes the volume of the other synthetic speech waveform b/(a+b), where a is a value of a parameter of the importance of the one synthetic speech waveform, and b is a value of a parameter of the importance of the other synthetic speech waveform.

12. A speech synthesizing method according to claim 11, further comprising a receiving step of receiving the plurality of text data and importance data indicative of the importance of the plurality of text data from the outside of the apparatus.

13. A storage medium storing therein a control program for making a computer perform the speech synthesizing method according to claim 11 or claim 12.

14. A control program for making a computer perform the speech synthesizing method according to claim 11 or claim 12.

15. A speech synthesizing method applied to a speech synthesizing apparatus for converting a plurality of text data into a synthetic speech and outputting it, said method comprising:

a speech waveform generating step of generating synthetic speech waveforms of said plurality of text data; and a speech outputting step of speech-synthesizing the synthetic speech waveforms generated from the plurality of text data at different volumes and outputting the synthetic speech waveforms at one time comprising:

a display control step of controlling the displaying of a setting screen configured to set the importance of the plurality of text data;

a volume determining step of determining the volumes of the synthetic speech waveforms of each of the plurality of text data on the basis of the relative importance of the plurality of text data set by the setting screen; and a step of speech-synthesizing and outputting the synthetic speech waveforms generated from the plurality of text data at the volume determined by said volume determining step at one time, wherein when two synthetic speech waveforms overlap each other, said speech-synthesizing and outputting step makes the volume of one synthetic speech waveform a/(a+b) and makes the volume of the other synthetic speech waveform b/(a+b), where a is a value of a parameter of the importance of the one synthetic speech waveform, and b is a value of a parameter of the importance of the other synthetic speech waveform.

16. A speech synthesizing method according to claim 15, further comprising a receiving step of receiving the plurality of text data and importance data indicative of the importance of the plurality of text data from the outside of the apparatus.

17. A storage medium storing therein a control program for making a computer perform the speech synthesizing method according to claim 15 or claim 16.

18. A control program for making a computer perform a speech synthesizing method according to claim 15 or claim 16.

19. A speech synthesizing apparatus for converting a plurality of text data into synthetic speech and outputting it, comprising:

speech waveform generating means for generating synthetic speech waveforms of said plurality of text data;

overlap detecting means for detecting the overlap of the synthetic speech waveforms of the plurality of said text data;

display control means for controlling the displaying of a setting screen configured to set the importance of said plurality of text data in response to the output of said overlap detecting means;

volume determining means for determining the volumes of the synthetic speech waveforms of each of said plurality of text data on the basis of the importance of said plurality of text data set by the setting screen; and speech output means for speech-synthesizing and outputting synthetic speech waveforms generated from said plurality of text data whose overlap has been detected at the volume determined by said volume determining means, wherein when three or more synthetic speech waveforms overlap one another, said speech output means makes the volume of each output synthetic speech waveform a value obtained by dividing the value of an importance parameter of the importance of the synthetic speech waveform by the sum total of the values of importance parameters of all the synthetic speech waveforms s outputted in overlapping relation with one another.

20. A speech synthesizing method applied to a speech synthesizing apparatus for converting a plurality of text data into synthetic speech and outputting it, said method comprising:

a receiving step of receiving the plurality of text data;

a speech waveform generating step of generating synthetic speech waveforms from the received plurality of text data;

an overlap detecting step of detecting the overlap of the synthetic speech waveforms of the plurality of the text data;

a display control step of controlling displaying a setting screen configured to set the importance of the plurality of text data in response to the output of said overlap detecting step;

a volume determining step of determining the volumes of the synthetic speech waveforms of each of the plurality of text data on the basis of the importance of the plurality text data set in the setting screen; and a speech outputting step of speech-synthesizing and outputting the synthetic speech waveforms generated from the plurality of the text data whose the overlap has been detected at the volume determined by said volume determining step, wherein when three or more synthetic speech waveforms overlap one another, said speech outputting step makes the volume of each output synthetic speech waveform a value obtained by dividing the value of an importance parameter of the importance of the synthetic speech waveform by the sum total of the values of importance parameters of all the synthetic speech waveforms s outputted in overlapping relation with one another.

21. A speech synthesizing apparatus for converting a plurality of text data into synthetic speech and outputting it, said apparatus comprising:

a speech synthesizer configured to generate synthetic speech waveforms of the plurality of text data in accordance with the importance of the plurality of text data and outputting the synthetic speech waveforms at one time comprising:

display control means for controlling the displaying of a setting screen configured to set the importance of the plurality of text data;

volume determining means for determining the volumes of the synthetic speech waveforms of each of said plurality of text data on the basis of the importance of the plurality of text data set by the setting screen; and speech output means for speech-synthesizing and outputting synthetic speech waveforms generated from said plurality of text data at the volume determined by said volume determining means, wherein when three or more synthetic speech waveforms overlap one another, said speech output means makes the volume of each output synthetic speech waveform a value obtained by dividing the value of an importance parameter of the importance of the synthetic speech waveform by the sum total of the values of importance parameters of all the synthetic speech waveforms s outputted in overlapping relation with one another.

22. A speech synthesizing apparatus for converting a plurality of text data into synthetic speech and outputting it, said apparatus comprising:

a speech waveform generator configured to generate synthetic speech waveforms of the plurality of text data;

a display controller configured to control the displaying of a setting screen configured to set the importance of said plurality of text data;

a volume determining device configured to determine the volumes of the synthetic speech waveforms of each of said plurality of the text data on the basis of the importance of said plurality of text data set by the setting screen; and a speech output device configured to perform speech-synthesizing synthesizing the synthetic speech waveforms generated from the plurality of text data at different volumes determined by said volume determining device and outputting the synthetic speech waveforms at one time, wherein when three or more synthetic speech waveforms s overlap one another, said speech output device makes the volume of each output synthetic speech waveform a value obtained by dividing the value of an importance parameter of the importance of the synthetic speech waveform by the sum total of the values of importance parameters of all the synthetic speech waveforms s outputted in overlapping relation with one another.

23. A speech synthesizing method applied to a speech synthesizing apparatus for converting a plurality of text data into synthetic speech and outputting it, said method comprising:

a speech outputting step of generating synthetic speech waveforms of the plurality of text data in accordance with the importance of the plurality of text data and outputting the synthetic speech waveforms at one time, comprising:

a speech waveform generating step of generating synthetic speech waveforms from the plurality of the text data;

a display control step of controlling the displaying of a setting screen configured to set the importance of the plurality of text data;

a volume determining step of determining the volumes of the synthetic speech waveforms of each of the plurality of text data on the basis of the importance of the plurality text data set by the setting screen; and a speech outputting step of speech-synthesizing and outputting the synthetic speech waveforms generated from the plurality of the text data at the volume determined by said volume determining step at one time, wherein when three or more synthetic speech waveforms overlap one another, said speech outputting step of speech-synthesizing and outputting means makes the volume of each output synthetic speech waveform a value obtained by dividing the value of an importance parameter of the importance of the synthetic speech waveform by the sum total of the values of importance parameters of all the synthetic speech waveforms s outputted in overlapping relation with one another.

24. A speech synthesizing method applied to a speech synthesizing apparatus for converting a plurality of text data into a synthetic speech and outputting it, said method comprising:

a speech waveform generating step of generating synthetic speech waveforms of said plurality of text data; and a speech outputting step of speech-synthesizing the synthetic speech waveforms generated from the plurality of text data at different volumes and outputting the synthetic speech waveforms at one time comprising:

a display control step of controlling the displaying of a setting screen configured to set the importance of the plurality of text data;

a volume determining step of determining the volumes of the synthetic speech waveforms of each of the plurality of text data on the basis of the relative importance of the plurality of text data set by the setting screen; and a step of speech-synthesizing and outputting the synthetic speech waveforms generated from the plurality of text data at the volume determined by said volume determining step at one time, wherein when three or more synthetic speech waveforms overlap one another, said speech-synthesizing and outputting step makes the volume of each output synthetic speech waveform a value obtained by dividing the value of an importance parameter of the importance of the synthetic speech waveform by the sum total of the values of importance parameters of all the synthetic speech waveforms s outputted in overlapping relation with one another.

* * * * *

UNITED STATES PATENT AND TRADEMARK OFFICE

CERTIFICATE OF CORRECTION

PATENT NO. : 7,031,924 B2
APPLICATION NO. : 09/891389
DATED : April 18, 2006
INVENTOR(S) : Hiroyuki Kimura et al.

It is certified that error appears in the above-identified patent and that said Letters Patent is hereby corrected as shown below:

COLUMN 2
Line 27, “utterned” should read --uttered--.

COLUMN 3
Line 48, “embodiment 4” should read --embodiment (4)--.

COLUMN 5
Line 27, “pheneme” should read --phoneme--.
Line 39, “portio” should read --portion--.

COLUMN 10
Line 51, “maybe” should read --may be--.

COLUMN 11
Line 36, “pheneme” should read --phoneme--.
Line 43, “pheneme” should read --phoneme--.

COLUMN 16
Line 12, “synthesize” should read --synthesizes--.

COLUMN 17
Line 50, “kindes” should read --kinds--.

COLUMN 18
Line 49, “portions 905” should read --portion 905--.
Line 51, “four the” should read --fourth--.

COLUMN 20
Line 36, “convers action” should read --conversation--.

COLUMN 23
Line 1, “appointing” should read --a pointing--.

UNITED STATES PATENT AND TRADEMARK OFFICE

CERTIFICATE OF CORRECTION

PATENT NO. : 7,031,924 B2
APPLICATION NO. : 09/891389
DATED : April 18, 2006
INVENTOR(S) : Hiroyuki Kimura et al.

It is certified that error appears in the above-identified patent and that said Letters Patent is hereby corrected as shown below:

COLUMN 24
Line 27, “where t1” should read --where t0--.
Line 47, “for for” should read --for--.
Line 49, “for for” should read --for--.
Line 56, “for for” should read --for--.
Line 58, “for for” should read --for--.

COLUMN 28
Line 63, “become” should read --becomes--.

COLUMN 29
Line 20, “store” should read --stored--.
Line 35, “If” should read --Of--.
Line 48, “down load,” should read --download,--.
Line 58, “realize” should read --realized--.

COLUMN 30
Line 57, “plurality” should read --plurality of--.

COLUMN 32
Line 29, “plurality” should read --plurality of--.

COLUMN 33
Line 55, “waveforms s” should read --waveforms--.

COLUMN 34
Line 8, “plurality” should read --plurality of--.
Line 11, “the overlap” should read --overlap--.
Line 20, “waveforms s” should read --waveforms--.
Line 48, “waveforms s” should read --waveforms--.
Line 62, “the text” should read --text--.

UNITED STATES PATENT AND TRADEMARK OFFICE

CERTIFICATE OF CORRECTION

PATENT NO. : 7,031,924 B2
APPLICATION NO. : 09/891389
DATED : April 18, 2006
INVENTOR(S) : Hiroyuki Kimura et al.

It is certified that error appears in the above-identified patent and that said Letters Patent is hereby corrected as shown below:

COLUMN 35
Line 5, “s overlap” should read --overlap--.
Line 10, “waveforms s” should read --waveforms--.
Line 30, “plurality text” should read --plurality of text--.

COLUMN 36
Line 4, “waveforms s” should read --waveforms--.
Line 36, “waveforms s” should read --waveforms--.

Signed and Sealed this

Eighteenth Day of March, 2008

JON W. DUDAS
*Director of the United States Patent and Trademark Office*